US005881337A

United States Patent [19]

Higashikawa et al.

[11] Patent Number: 5,881,337

[45] Date of Patent: Mar. 9, 1999

[54] SHEET ALIGNING APPARATUS AND PROCESSING APPARATUS USED FOR COPYING MACHINE

[75] Inventors: Koji Higashikawa, Toyokawa; Satoshi Fujii, Hoi-gun, both of Japan

[73] Assignee: Minolta Co., Ltd., Osaka, Japan

[21] Appl. No.: 839,785

[22] Filed: Apr. 16, 1997

[30] Foreign Application Priority Data

| | | | |
|---|---|---|---|
| Apr. 18, 1996 | [JP] | Japan | 8-097128 |
| Apr. 18, 1996 | [JP] | Japan | 8-097129 |
| Apr. 18, 1996 | [JP] | Japan | 8-097130 |

[51] Int. Cl.[6] ..... G03G 15/00

[52] U.S. Cl. ..... 399/82; 399/83; 399/367; 270/58.12; 271/288; 271/298

[58] Field of Search ..... 399/82, 83, 367, 399/369, 81, 365, 374, 405, 407, 408, 410; 271/221, 176, 288, 298, 265.01, 265.02

[56] References Cited

U.S. PATENT DOCUMENTS

| | | | |
|---|---|---|---|
| 5,045,880 | 9/1991 | Evanitsky et al. | 399/82 |
| 5,221,953 | 6/1993 | Higaki . | |
| 5,243,381 | 9/1993 | Hube | 399/84 |
| 5,305,056 | 4/1994 | Salgado et al. | 399/11 |
| 5,587,799 | 12/1996 | Kawamura et al. | 358/296 |
| 5,669,040 | 9/1997 | Hisatake | 399/83 |

FOREIGN PATENT DOCUMENTS

| | | |
|---|---|---|
| 56-54455 | 5/1981 | Japan . |
| 59-200270 | 11/1984 | Japan . |
| 5-204207 | 8/1993 | Japan . |

*Primary Examiner*—Matthew S. Smith
*Attorney, Agent, or Firm*—McDermott, Will & Emery

[57] ABSTRACT

A processing apparatus is utilized for a copying machine capable of executing successively a first job and then a second job. An user inputs the number of originals, the number of copies to be made, or the like using a picture plane for setting the first job. Based on information about the input numbers of originals and copies, and information about a copying operation that can be carried out by the copying machine, the number of originals and the number of copies that can be set for the second job are determined. The determined numbers of originals and copies are displayed. Accordingly, the number of originals and the number of copies which exceed a limitation of processing by the copying machine would not be input, thereby improving handling of the apparatus.

8 Claims, 27 Drawing Sheets

SHEET ALIGNING APPARATUS AND PROCESSING APPARATUS USED FOR COPYING MACHINE

BACKGROUND OF THE INVENTION

1. Field of the Invention

The present invention relates to a sheet aligning apparatus and a processing apparatus, and more particularly relates to a sheet aligning apparatus and a processing apparatus used for a copying machine capable of processing a plurality of jobs successively.

2. Description of the Related Art

A copying machine having a multi-job function has been known. The multi-job function refers to a function of processing two groups of original documents successively by setting the two groups of originals (a group of originals for a first job and a group of originals for a second job) at an automatic document feeder (hereinafter referred to as "ADF") of the copying machine.

In addition, an aligning function is provided for matching the positions of the copied sheets if there produced a plurality of copied sheets in such a copying machine. When the copied sheet for the first job and the one for the second job discharged onto the same tray are different in size, the aligning function does not work.

The multi-job is also applied when the number of original sheets to be set at ADF exceeds the loading capacity of the tray of ADF. The originals are divided into those for the first job and those for the second job to be set by an user, allowing consecutive processing of the originals.

Japanese Patent Laid-Open No. 56-54455 discloses a technique of controlling a job by reading out information using ADF concerning the job written by an user on a sheet.

These copying machines exhibit a problem of poor operability. Specific problems are given below.

(1) First problem

In the conventional copying machine, if the sizes of the copied sheets are different between the first job and the second job, the copied sheets are not aligned since the aligning function does not work.

In order to solve this problem, copy operation for the second job may be suspended until aligned sheets for the first job are removed.

However, this process could lower working efficiency.

(2) Second problem

There is a copying machine having a function of post-processing the sheets after copying. The post-processing refers to a process such as stapling of the discharged sheets which have been aligned.

A problem of such a copying machine is that even if one group of originals are divided into a plurality of groups for a plurality of jobs to be set, the copying machine cannot recognize the state in which the group of originals is divided, so that the divided groups of originals are post-processed separately.

(3) Third problem

According to the conventional multi-job control, when the process for the second job is carried out in succession after completion of the first job, the total of the sheets to be processed often exceeds the amount that the copying machine can process. For example, setting of the number of sheets to be copied could exceed limitations of the number of copies because of the limitations of the number of bins of the sorter.

If all the bins of the sorter are utilized for sorting operation in the first job, the sorting operation is impossible for the second job. However, the copying machine cannot recognize such a state.

The invention is made to solve the problems described above. The first object of the invention is to enhance operability of an image forming apparatus (e.g. copying machine) capable of executing a plurality of jobs successively.

The second object of the invention is to provide a sheet aligning apparatus capable of aligning sheets of different sizes appropriately.

The third object of the invention is to provide a sheet aligning apparatus capable of precisely carrying out post-processing even if one group of original documents is divided into those for a plurality of jobs.

The fourth object of the invention is to provide a processing apparatus capable of suitably carrying out processes in an image forming apparatus which can process a plurality of jobs successively.

SUMMARY OF THE INVENTION

In order to achieve those objects described above, according to one aspect of the invention, a processing apparatus used for an image forming apparatus capable of executing a plurality of jobs successively includes: an input unit for inputting information as to a copying operation for a first job; and a determining unit for determining a copying operation which can be set for a second job carried out after the first job, based on the information input by the input unit and information as to a copying operation which can be executed by the image forming apparatus.

According to another aspect of the invention, a sheet aligning apparatus includes: a loading unit which can load a plurality of stacked sheets; a comparing unit which determines and compares respective sizes of at least two sheets which are at least partially stacked and loaded on the loading unit; and an aligning unit which aligns at least two sheets which are loaded in the stacked state, based on the result of comparison by the comparing unit.

According to still another aspect of the invention, a sheet aligning apparatus includes: a loading unit capable of loading a plurality of sheets; a first discharge unit which discharges a group of sheets for a first job to the loading unit; a second discharge unit which discharges a group of sheets for a second job onto the discharged group of sheets for the first job; a determining unit which determines continuity between the first and second jobs; and a post-processing unit which carries out a post-process to be performed for the group of sheets for the first job when discharging of the group of sheets for the second job is completed, based on the result of the determination by the determining unit.

First, according to the present invention, operability of an image forming apparatus capable of performing a plurality of jobs successively can be enhanced.

Secondly, a sheet aligning apparatus capable of aligning sheets of different sizes appropriately can be provided.

Thirdly, a sheet aligning apparatus which can perform post-process precisely even if one group of sheets is divided into those for a plurality of jobs can be provided.

Fourthly, a processing apparatus which can perform an appropriate process for an image forming apparatus capable of carrying out a plurality of jobs successively can be provided.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS (Structure and Operation of Entire Copying Machine)

Figure 1:
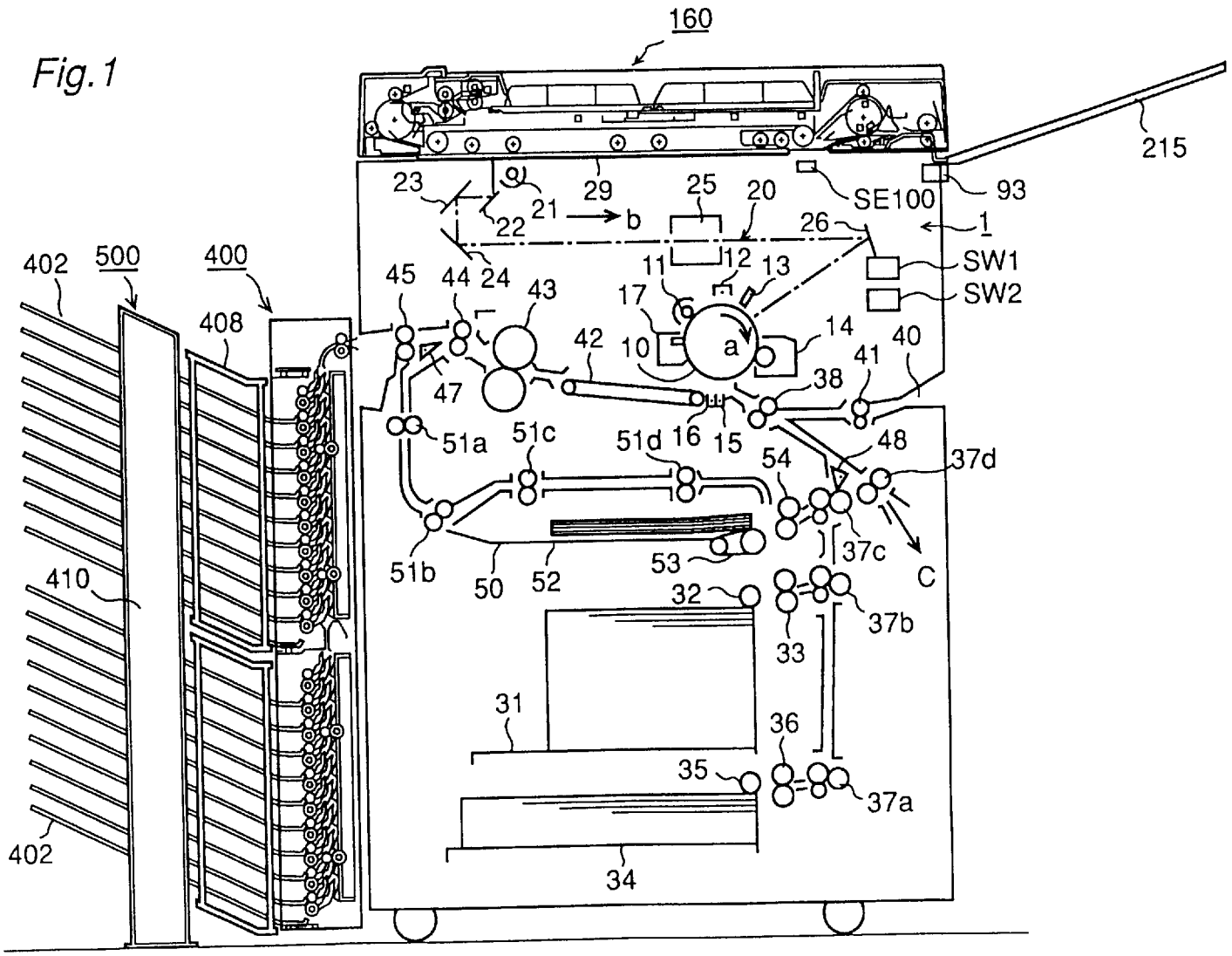
FIG. 1 is a cross section showing a structure of a copying machine according to one embodiment of the invention.

FIG. 1 shows an entire structure of a copying machine according to one embodiment of the present invention.

Referring to the figure, at an almost central portion of a main body of a copying machine 1, a photoreceptor drum 10 having a photoreceptor layer around its outer surface is placed such that it can be driven to rotate in the direction of an arrow a at a constant peripheral velocity v. At the periphery of photoreceptor drum 10, a main eraser 11, a corona charger 12, a sub-eraser 13, a developing device 14 adopting magnetic brush method, a transfer charger 15, a sheet separation charger 16, and a cleaner 17 with a blade are arranged in order along the direction of the rotation of photoreceptor drum 10. An optical system 20 is positioned above photoreceptor drum 10.

Photoreceptor drum 10 rotates in the direction of arrow a, main eraser 11, corona charger 12, and sub-eraser 13 respectively carry out discharging, charging and discharging between images/discharging of the image edge, and an image on an original document placed on a platen glass 29 is exposed by optical system 20. An electrostatic latent image formed on photoreceptor drum 10 through the exposure is made visible as a toner image by developing device 14.

Optical system 20 placed directly under platen glass 29 scans and illuminates the image of the original having its one end set in accordance with an exposure reference or reference position SP. The reflected light is directed onto photoreceptor drum 10 for the exposure. In this scanning of the image, an exposure lamp 21 and a first mirror 22 are moved in the direction of an arrow b at the velocity of v/m (m: copy magnification) where the peripheral velocity of photoreceptor drum 10 is v (which is constant irrespective of equal or variable scale magnification).

At the same time, a second mirror 23 and a third mirror 24 are moved in the direction of the arrow b at the velocity of v/2m. When the copy magnification is changed, a projection lens 25 moves along an optical axis, and a fourth mirror 26 swings or rotates in order to correct the optical path length.

Copy papers or copy sheets are contained in an upper paper feed unit 31 of elevate type and a lower paper feed unit 34 of tray type, and supplied one by one from either of them according to the selection made by an operator. Paper feed units 31 and 34 are respectively provided with paper feed rollers 32 and 35, and sort rollers 33 and 36 consisting of normal rotation rollers and reverse rotation rollers. The sheet supplied from upper paper feed unit 31 is transported to a timing roller 38 placed just in front of an image transfer portion through transport rollers 37*b*, 37*c*. The sheet supplied from lower paper feed unit 34 is transported to timing roller 38 through transport rollers 37*a*, 37*b*, 37*c*.

Manual feeding is possible in this copying machine. A copy sheet provided from a manual feed inlet 40 is transported from paper feed roller 41 to timing roller 38.

The sheet transported to timing roller 38 is temporarily stopped there, and sent to the transfer portion when timing roller 38 is turned on in synchronization with the image formed on photoreceptor drum 10. The sheet is closely fit to the photoreceptor drum at the transfer portion, a toner image is transferred by corona discharging from transfer charger 15, and the sheet is separated from photoreceptor drum 10 due to alternating corona discharging from separation charger 16 and the resiliency of the sheet itself.

The sheet is thereafter sent to a fixing unit 43 through a transport belt 42 where toner is fixed, and discharged onto a sorter 400 through a transport roller 44 and a discharge roller 45. On the other hand, photoreceptor drum 10 continues to rotate in the direction of the arrow a after the transfer, residual toner is removed by cleaner 17, and residual charge is erased by main eraser 11. Thus, photoreceptor drum 10 gets ready for the next copying process.

A re-feed unit 50 and paper travel path switching claws 47, 48 are provided in the body of copying machine 1 in order to handle duplex/composite copying. Usually switching claw 47 is set at the position illustrated by the solid line, and directs the sheet to sorter 400. At the time of duplex or composite copying, the sheet with its first side (front side) having an image of an odd numbered original sheet transferred thereon is discharged to an intermediate tray 52 through transport rollers 51*a*, 51*b*, 51*c*, 51*d* by rotating switching claw 47 slightly in the anticlockwise direction to be set. The discharged sheet is accommodated in intermediate tray 52 with its image side facing upward. When a re-feed signal is generated after a prescribed number of sheets are accommodated on intermediate tray 52, the sheets are fed one by one from the lowest one by rotation of re-feed belt 53 and sort roller 54 to transport roller 37*c*.

In the duplex copy mode, the re-fed sheet is transported to timing roller 38 directed upward by switching claw 48 set at the position shown by the solid line, an image is transferred and fixed on a second side (backside), and the sheet is discharged to sorter 400.

In the composite copy mode, the re-fed sheet is transported in the direction of an arrow c by transport roller 37*d* by rotating switching claw 48 slightly in the clockwise direction to be set. Just before the rear end of the sheet passes a nip portion of transport roller 37*d*, rotation of transport roller 37*d* is reversed, and the sheet is transported to timing roller 38 with its front and back as well as front and rear sides reversed. An image is superimposed on the first side (front side) of the sheet to be transferred and fixed, and the sheet is discharged to sorter 400.

In the body of copying machine 1, when copying process is started and a first sheet is waited immediately before timing roller 38, a preliminary paper feeding process is carried out in which those sheets from the second one are fed to a paper feed path in advance.

For example, when a sheet is fed from lower paper feed unit 34, a second sheet is supplied to the paper feed path after the first sheet, and the third sheet is further supplied to the location just in front of transport roller 37*a*. Such a preliminary feeding process is applied to the simplex copy mode utilizing an ADF 160 as well as the multiple copy mode in order to improve copying speed.

(Structure and Operation of Sorter Unit)

Figure 2:
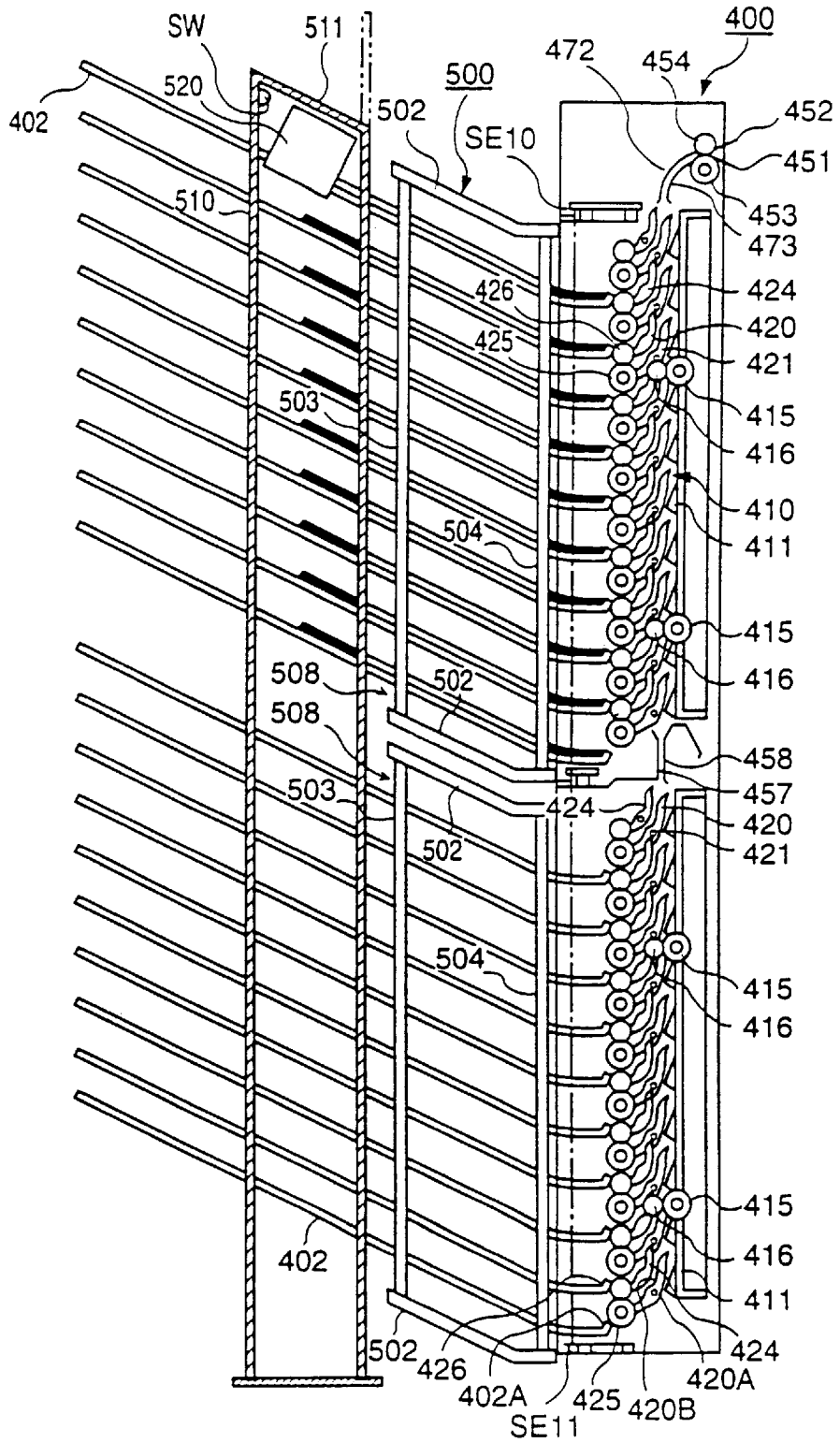
FIG. 2 shows a configuration of a sorter of FIG. 1.

With reference to FIG. 2, sorter unit 400 comprises twenty stages of bins 402 for storing the sheets distributed thereto, a vertical transport path 410, a switching claw 420 corresponding to each of bins 402, and discharge rollers 425, 426. Sorter 400 is divided into an upper section including ten stages of bins and a lower section including ten stages of bins.

Vertical transport path 410 comprises a vertical guide frame 411, four transport rollers 415, pinch rollers 416 which are pressed against transport rollers 415 and which rotate following transport rollers 415, switching claws 420 provided corresponding to respective bins 402, a guide plate 424, a discharge roller 425, and a pinch roller 426 pressed against discharge roller 425 and rotated following the discharge roller 425.

The upper and lower portions are connected at the intermediate region by guide plates 457, 458.

At the entrance of sorter 400, guide plates 451, 452, sheet receiving rollers 453, 454, guide plates 472, 473 for directing the sheet to the upper part of vertical transport path 410. As sheet detecting means, transmission type photosensors SE10, SE11 for detecting the presence of the sheet in bin 402 of upper and lower groups of bins respectively, as well as a transmission type photosensor SE13 (not shown) for detecting a sheet which is to be stored in each bin 402.

All of the switching claws 420 except for the one opposite of the lowest stage of bin 402 can be rotated by their exclusive solenoids so as to pivot on a shaft 421 as a fulcrum. When each of the solenoids is off, corresponding switching claw 420 is at a position as indicated by the solid line in FIG. 2, so that a sheet is directed downward by a vertical surface 420*a* and vertical guide frame 411.

The sheet is transported in the vertical direction by transport rollers 415, 416.

On the other hand, when each of the solenoids is turned on, switching claw 420 is switched as indicated by the dashed line at the top stage in FIG. 2, the sheet is directed by a curved surface 420*b* and each of guide plates 424, and discharged to each of bins 402 from discharge rollers 425, 426.

When the sorting mode is selected, the switching of switching claw 420 is performed in response to the timing of detection of the rear end of the sheet by sensor SE13. The claws are switched in order from the top one downward corresponding to the set number of copies (the number of sheets to be copied), and the sheets are distributed among the bins in order from the first (top) to the bottom stages of bins 402.

When a grouping mode is selected, where the sheets corresponding to the number of copies are stored in the same bin 402, switching claw 420 is switched in response to completion of copying of the last one of the number of copies.

Switching claw 420 for the lowest stage (the twentieth stage) is fixed at a position for directing the sheet to the lowest stage of bin 402 by its curved surface 420*b*.

(Structure and Operation of Finisher Unit)

Figure 3:
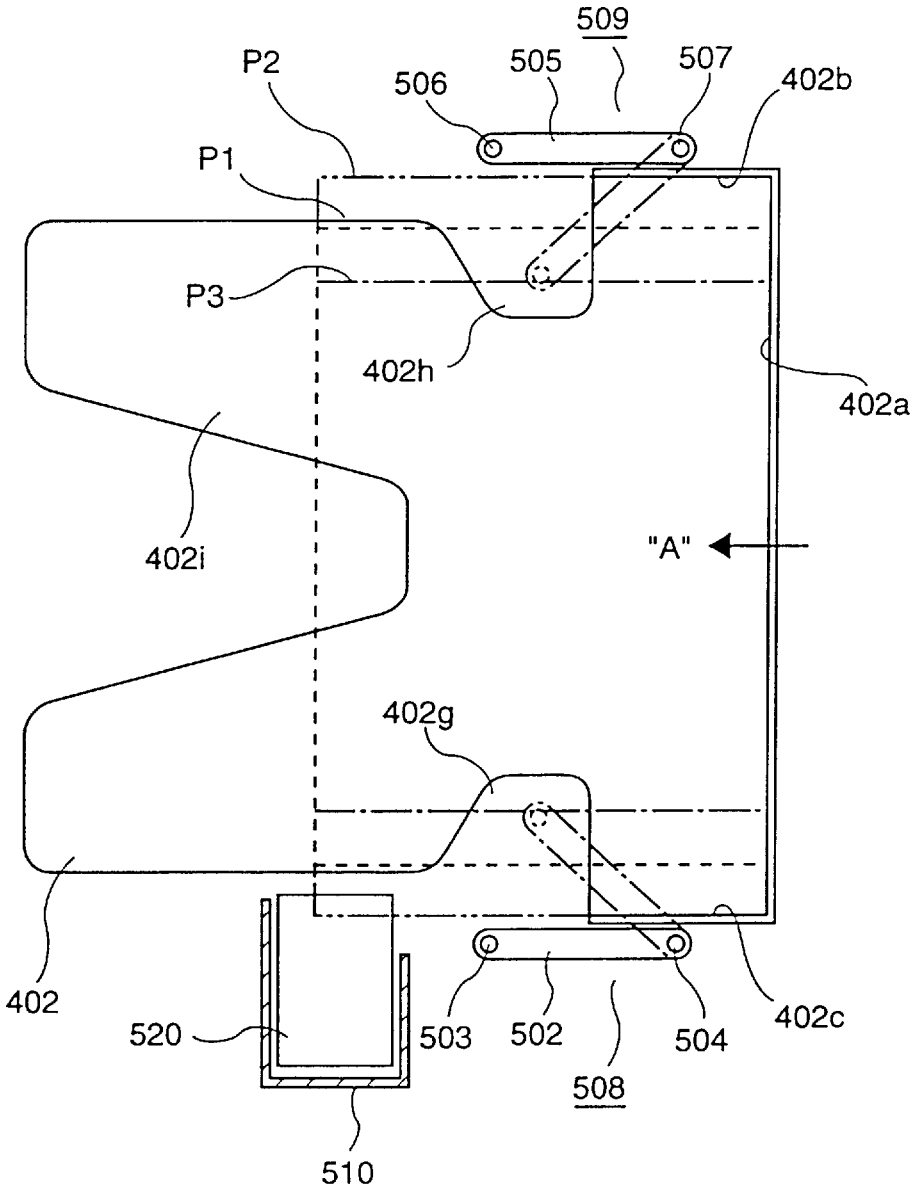
FIG. 3 is a plan view of a finisher unit of FIG. 2.

Referring to FIGS. 2 and 3, a finisher unit 500 comprises a stapler 520 provided in the front side, an aligning unit 508 for pushing a sheet stored in bin 402 against an alignment reference plate 402*b* in the rear side, a pushing unit 509 for pushing a sheet against a stapling reference plate 402*c* which regulates the sheet in a position to be engaged with stapler 520, and a moving unit 700 for moving pushing unit 509 and stapler 520 to positions corresponding to respective bins 402.

Each bin 402 is set to rise and slope with respect to the forward direction (direction "A" in which a sheet enters to be stored), having an uniform interval in the vertical direction. Alignment reference plate 402*b* and stapling reference plate 402*c* are provided for each bin 402 as one unit.

Further, each bin 402 has a reversion prevention plate 402*a* for stopping the rear edge of a sheet stored in each bin 402. Each bin 402 is also provided with notches 402*g*, 402*h* at both sides of itself in which aligning unit 508 and pushing unit 509 can move, and a notch 402*i* for allowing an operator to manually taking out the sheet.

As shown in FIGS. 2 and 3, in aligning unit 508, an alignment stick 503 and a shaft 504 are attached to both ends of a support lever 502. Lever 502 is capable of pivoting on a horizontal surface with shaft 504 as a fulcrum. Alignment unit 508 is divided into two units for handling the upper group of bins and the lower group of bins individually, and respective units are provided with drive devices (e.g. solenoid)(not shown).

Alignment operation is carried out for every sheet stored in bin 402. Specifically, every time a sheet is stored in bin 402, aligning unit 508 pivots on shaft 504 and comes into a position indicated by the dashed line in FIG. 3. The sheet is pushed against alignment reference plate 402*b* in order to align the sheet between alignment stick 503 and alignment reference plate 402*b*.

As for the direction in which the sheet is transported to be stored, the sheet contacts with reversion prevention plate 402*a* due to the weight of itself since bin 402 inclines, so that the sheet is automatically aligned.

Figure 4:
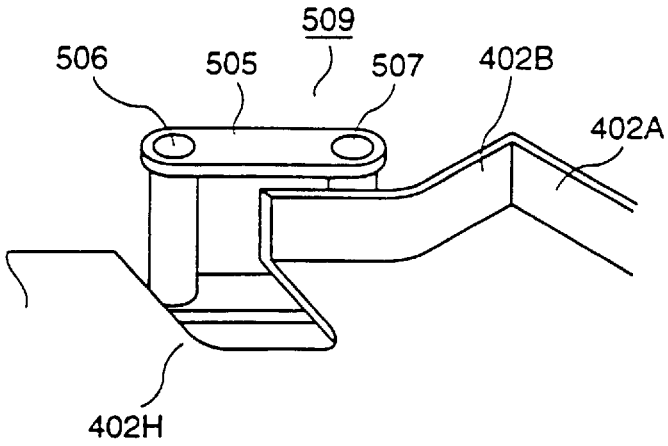
FIG. 4 is a perspective view of a pushing unit of FIG. 3.

As shown in FIGS. 3 and 4, in pushing unit 509, a pushing stick 506 and a shaft 507 are attached to both ends of a support lever 505. Support lever 505 is capable of pivoting on the horizontal surface with shaft 507 as a fulcrum, and provided with a source of drive (e.g. solenoid)(not shown).

Pushing unit 509 is movable to positions corresponding to respective bins 402 from the top to the bottom stages of bins 402, and moves up and down in synchronization with the movement of stapler 520. Pushing operation of the sheet is carried out after completion of the sorting operation for every bin 402.

Specifically, pushing unit 509 is moved along with stapler 520 to the side of bin 402 for which stapling process is performed. Pushing unit 509 pivots to the position indicated by the dashed line in FIG. 3 with shaft 507 as a fulcrum, then pushes the sheet against staple reference plate 402*c*. Thus, the sheet is shifted from an alignment position P2 indicated by the chain double-dashed line to a stapling position P3 indicated by the dashed line, where the sheet is engaged with stapler 520.

In this state stapler 520 operates to bind the sheets. Thereafter aligning unit 508 again pivots inward, and pushes the stapled sheets against alignment reference plate 402*b* using alignment stick 503. The stapled sheets are thus returned to alignment position P2 from stapling position P3 in order to separate the sheets from stapler 520. Then, pushing unit 509 and stapler 520 move to a next bin position.

(Structure and Operation of Stapler and Stapler Moving Unit 700)

Figure 5:
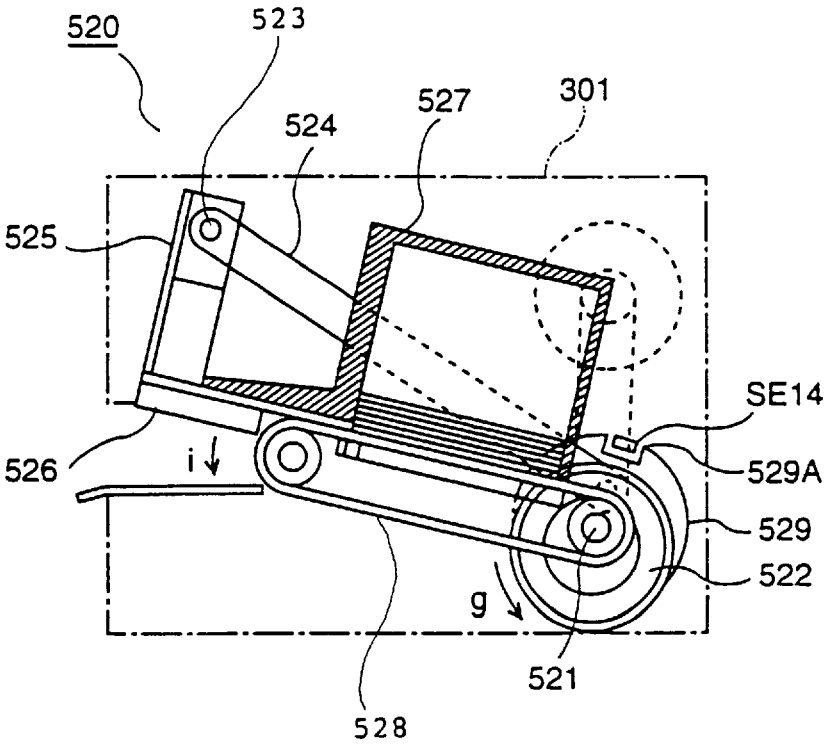
FIG. 5 is a cross section showing a structure of a stapler.

Referring to FIG. 5, in stapler 520, a cam 522 is fixed on a motor output shaft 521, and an arm 524 capable of swinging freely with a pin 523 as a fulcrum connects a peripheral portion of cam 522 and a head 525. As cam 522 is rotated in a direction indicated by an arrow g by rotation of the motor, head 525 moves in a direction indicated by an arrow i via arm 524. The sheets aligned in bin 402 are bound with a staple 526.

A plate-like block of straight staples 526, which are joined together by adhesive, is contained in a cartridge 527 in advance, having a prescribed number of staples resiliently pressed downward using a spring member (not shown). Staples 526 are supplied to the head portion one by one from the bottom one through a transport belt 528 which is driven to rotate by motor output shaft 521.

A reflective type photosensor is provided in stapler 520 for detecting existence of staples 526. When the last staple 526 passes the detection point, the staple detecting sensor is turned off, so that it is detected that there is no staple 526. Further, stapler 520 is provided with a photosensor SE14 for detecting rotation frequency of the stapling motor. Sensor SE14 senses a notch 529*a* of a disk 529 fixed on motor output shaft 521.

Stapler 520 is provided in a protection case 510 disposed vertically in front of bin 402, and can move up and down within the case. Protection case 510 has an openable cover 511 on the top. Cover 511 is opened for supplying staples, and a switch SW1 detects whether the cover is opened or closed.

Figure 6:
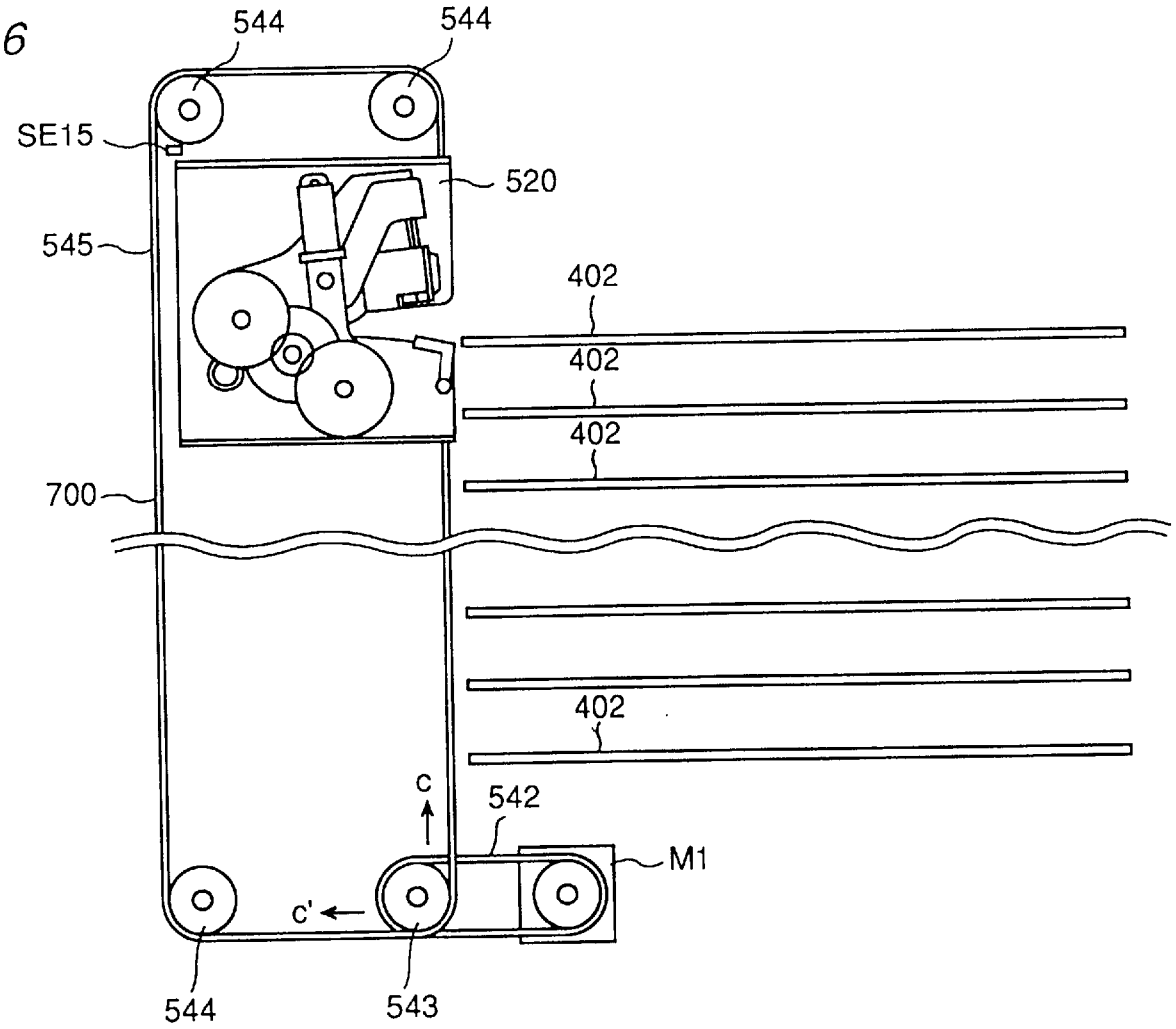
FIG. 6 shows a mechanism for driving the stapler.

Stapler 520 in protection case 510 is fixed to a belt 545 stretched endlessly around rollers 543, 544 as shown in FIG. 6. Belt 545 is driven in a direction indicated by arrow c or c' by driving force transmitted from a stepping motor M1 through a belt 542 to roller 543.

Stapler 520 moves up and down in accordance with movement of belt 545 in the direction of arrow c or c' and is set at a prescribed bin position. Pushing unit 509 also moves up and down in synchronization with stapler 520 through a link portion (not shown).

Stapler 520 is returned to a home position corresponding to the top bin 402 as an initial position for stapling. A photosensor SE15 detects stapler 520 set in the home position. The stapling proceeds as stapler 520 is moving down step by step corresponding to every one of bins 402. Stapler 520 thus binds the sheets on bin 402 for every bundle of sheets.

The travel distance of stapler 520 is detected and controlled by counting pulses driving the stepping motor M1. During a series of stapling processes, if non-presence of staples is detected by sensor SE18, stapling process is discontinued, and the position of stapler 520 is stored using the number of driving pulses therebefore.

Stapler 520 is thereafter moved to the home position. An operator opens a cover 511 in order to replace cartridge 527 with the new one. Completion of the cartridge replacement is detected by turning on of sensor SE18 and turning on of switch SW1.

Stapler 520 is then moved down by an amount of the stored number of pulses to the original position, and the stapling is continued.

(Structure and Operation of ADF)

Description of the structure and operation of an ADF (automatic document feeding mechanism) 160 is given below.

Figure 7:
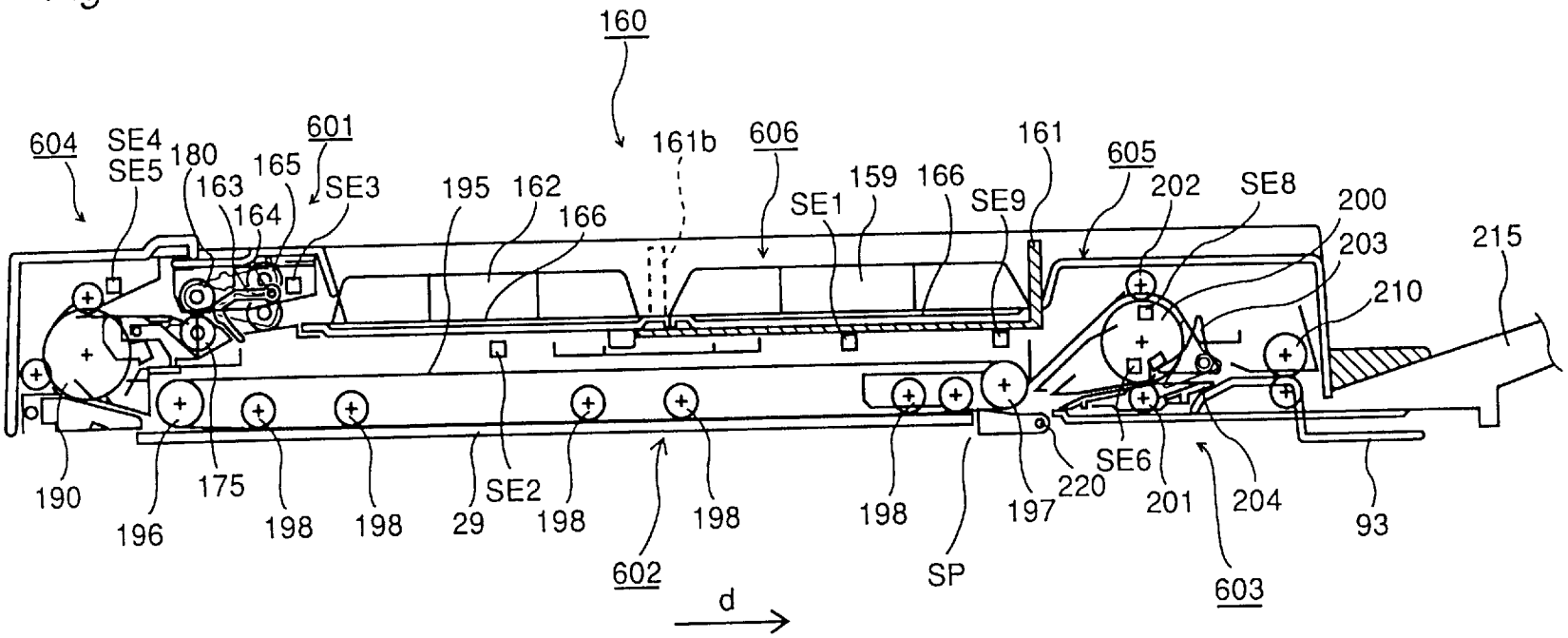
FIG. 7 is a cross section of ADF of FIG. 1.

With reference to FIG. 7 first, general structure and operation of ADF 160 will be described. Generally, ADF 160 is constituted by a document feed portion 601, a document transport portion 602, a document discharge portion 603, a document travel portion 606, and a paper discharge tray operation unit 93 (also referred to as shift block).

Document feed portion 601 comprises a front end restriction plate 163, a pickup roller 165, a sort roller 175, a normal rotation roller 180, and a resist roller 190. Components except for a travel tray 161 are covered with a cover 604 which can be opened and closed freely. Document transport portion 602 is provided with a drive roller 196 arranged adjacent to document feed portion 601, a following roller 197 arranged adjacent to document discharge portion 603, and a transport belt 195 which are covered with a cover 166 constituting travel tray 161.

Document discharge portion 603 is provided with a reversing roller 200, a discharge roller 210, and a discharge tray 215. Components except for discharge tray 215 are covered with a cover 605.

Document travel portion 606 is constituted by travel tray 161 and a travel mechanism. Paper discharge tray operation unit 93 is constituted by an operation unit which moves discharge tray 215 in the direction perpendicular to the surface where papers are transported.

ADF 160 is mounted on the top surface of the body of copying machine 1 such that transport belt 195 is positioned on platen glass 29. ADF 160 can be opened to expose the top surface of platen glass 29 using a hinge fitting (not shown) provided at the inner side, i.e., the portion opposite to the operation side.

When an original document is set on platen glass 29 manually by an operator, ADF 160 is lifted to expose the upper surface of platen glass 29. Sensor SE 100 shown in FIG. 1 detects opening/closing of ADF 160. Detection of correctly closed ADF 160 by sensor SE 100 enables operation of ADF 160.

An original to be supplied is placed on travel tray 166 with its first page facing upward. The position of the original is restricted by side restriction plates 159 and 162 in the direction of its width, and the position of the front end of the original is restricted by front end restriction plate 163. Front end restriction plate 163 is rotatable about a shaft 164 as a fulcrum. Front end restriction plate 163 is retracted upward from the supply of the first original until completion of the last original.

Pickup roller 165 and normal rotation roller 180 are driven to rotate respectively in the clockwise direction at the time of paper feeding. Originals are passed between normal rotation roller 180 and sort roller 175 and sent to resist roller 190 one by one from the top one. Resist roller 190 temporarily holds the supplied original at its nip portion, and is driven to rotate after a prescribed time period so as to transport the original to the entrance portion of platen glass 29.

Transport belt 195 is extended between drive roller 196 and following roller 197 endlessly such that it covers the entire surface of platen glass 29. Inside of transport belt 195, multiple backup rollers 198 are rotatably placed for pressing belt 195 against platen glass 29. Transport belt 195 is driven to rotate in the direction of an arrow d, and adjusts the front end of the original to match with reference position (exposure reference) SP located at the boarder between a scale 220 and platen glass 29 for starting exposure.

Pinch rollers 201, 202, and a switching claw 203 are provided adjacent to reversing roller 200 used for switching the paper feeding path so as to reverse the original in the double sided original mode. Generally, switching claw 203 is set at the position shown by the solid line. After exposure, the original is discharged from platen glass 29 by movement of document transport belt 195 in the direction of arrow d and rotation of reversing roller 200 in the anticlockwise direction, directed upward by a guide plate 204 and switching claw 203, and discharged onto discharge tray 215 having travel mechanism due to discharge roller 210. As for a double sided original document, a second side (back side) should be first copied. Therefore, when the double sided original is supplied onto platen glass 29, switching claw 203 is rotated in the anticlockwise direction by a prescribed angle from the position shown in the figure, so that the double sided original is reversed and transported around reversing roller 200 and returned to platen glass 29 with its second side facing downward. At this time, transport belt 195 is driven to rotate in the direction opposite to arrow d. Further, after the exposure of the second side of the double sided original, the original is again reversed and transported around reversing roller 200 for copying of the first side (front side).

Reversing roller 200 and discharge roller 210 are driven to rotate by a discharge motor M4 (not shown). Various sensors SE1–SE6 for detecting an original are provided for ADF 160.

Sensors SE1 and SE2 detect the presence of an original on tray 166.

Sensor SE4 is arranged immediately before resist roller 190 for detecting arrival and passage of an original, and for detecting the length of the original in corporation with a timer when the original is sent out from resist roller 190.

Sensor SE5 is located in line with sensor SE4 for detecting the size of the width of the original.

Based on an original document detection signal generated by sensors SE4 and SE5, the size of the original as well as the direction of the transport, i.e. whether the original is transported in lengthwise direction (the longer side of the original is parallel with the direction of transport), or transported in widthwise direction (the shorter side is parallel with the direction of transport), are determined. Sensor SE6 is provided at the entrance portion of reversing roller 200 for detecting an original passed therethrough.

Sensor SE3 is an empty sensor for detecting absence of an original on document tray 166 after the last one of a batch of originals is passed.

A sensor (not shown) is provided within the main body for detecting the size and presence of an original. In addition, a sensor SE9 is provided for detecting whether travel tray 161 is located at the home position.

An operation for multiple jobs is described. An original for the first job is set between restriction plates 162, and an original for the second job is set on travel tray 161. Presence of the originals is detected respectively by sensor SE2 for the first job and by sensor SE1 for the second job.

The set originals are processed first from the one for the first job. In the second job, after completion of the first job is detected by sensor SE3, the original for the second job is moved by travel tray 161 to be processed.

Sensor SE1 is provided on travel tray 161 and moved with travel tray 161. Travel tray 161 is returned to the home position and at a certain timing.

(Operation of Shift Tray Mechanism)

Shift operation of document discharge tray 215 by the shift block (paper discharge tray operation unit) 93 shown in FIG. 7 is carried out as described below.

When multi-job is set, discharging of the last original sheet of each batch of original sheets is detected. When the transport of the original for the second job is started, original paper discharge tray 215 moves in a direction perpendicular to the direction of discharging, so that the batch of original sheets to be discharged are divided according to each job.

(Structure and Operation of Travel Mechanism of Document Batch)

Figure 8:
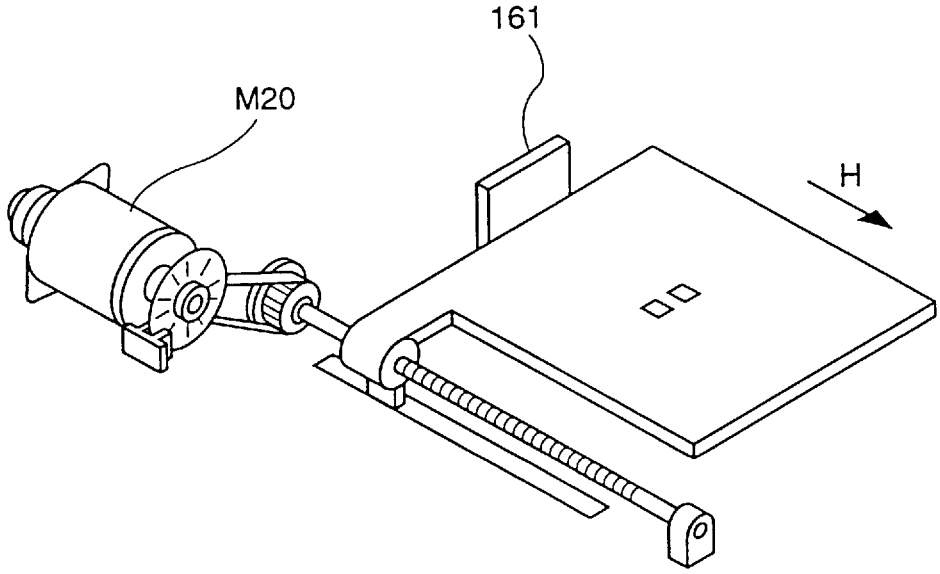
FIG. 8 shows a driving mechanism of a document travel tray of FIG. 7.

When empty sensor SE3 detects completion of processing of a batch of originals for the first job, if detection sensor SE1 for detecting the batch of originals for the second job detects presence of a batch on document travel tray 161, motor M20 is rotated to push the batch of originals in the direction of an arrow H at the trailing end of document travel tray 161 through transmission mechanism as shown in FIG. 8, so that the batch of originals is transported.

When empty sensor SE3 detects that the originals are transported, motor M2 stops. Motor M20 thereafter rotates in reverse direction, and driven until home position detection sensor SE9 detects that the document travel tray is located at the home position. The motor is stopped through detection by sensor SE9.

(Description of Panel)

Figure 9:
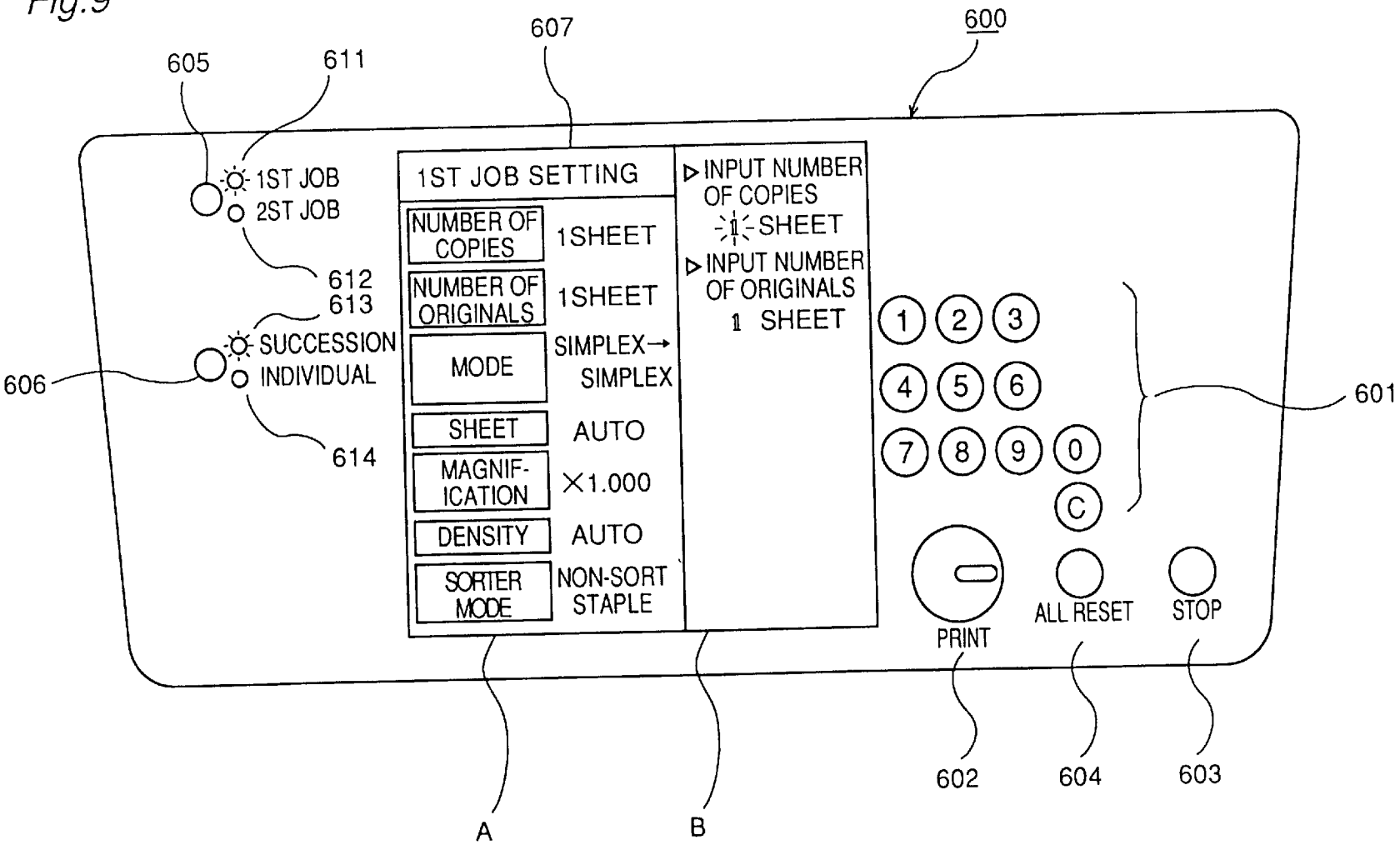
FIG. 9 is a plan view of an operation panel unit.

FIG. 9 is a front view of an operation panel unit 600.

With reference to the figure, operation panel unit 600 includes: a ten key 601 for directly setting the number of copies to be made, the copy magnification rate and the like; a print key 602 for specifying the start of copying operation; a stop key 603 for holding copying operation; an all reset key 604 for initializing the input settings; a job switch key 605 for changing the settings for the first job to the second job or for the second job to the first job of the multi-job; a job succession key 606 for switching between successive job and non-successive job for the first and second jobs of the multi-job; and a main panel 607 formed of an LCD (liquid crystal display) unit.

Main panel 607 is a touch panel constituted by a liquid crystal display unit 608 and a transparent touch switch 609 provided thereon.

An user can recognize the key input picture plane displayed on liquid crystal display unit 608 through touch switch 609 without parallax.

Further, operation panel unit 600 includes LEDs 611, 612 that are lit in accordance with operation of job switch key 605, and LEDs 613, 614 that are lit in accordance with operation of job succession key 606.

Figure 10:
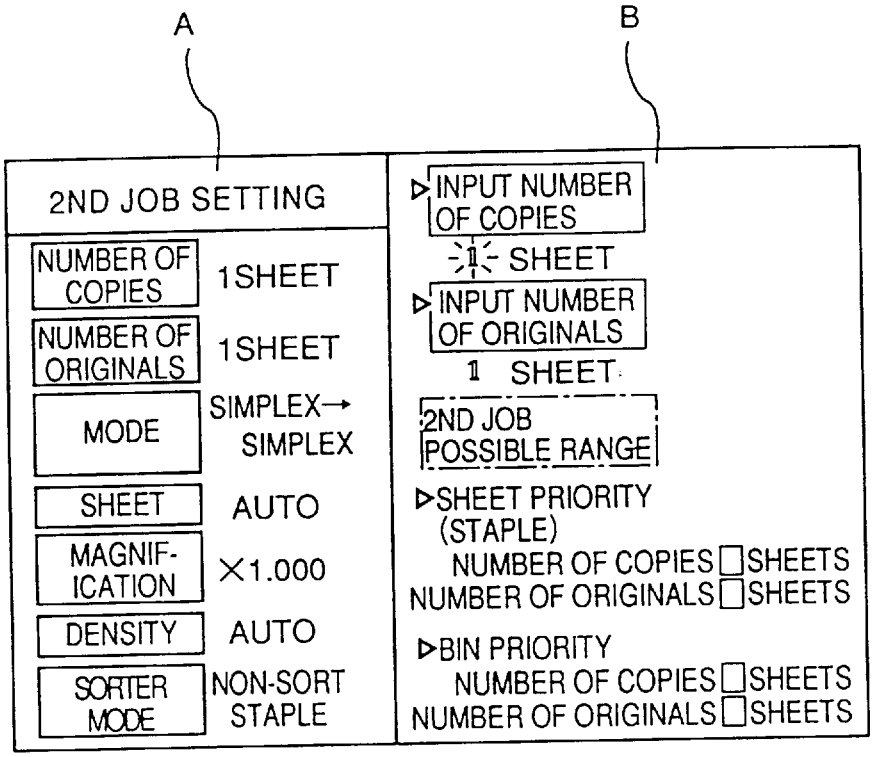
FIG. 10 shows a picture for setting the second job displayed on a main panel of FIG. 9.

On main panel 607, the picture plane for setting the first job shown in FIG. 9 and that for setting the second job shown in FIG. 10 are displayed switched from the one to the other. Main panel 607 is divided into display portions A and B.

The number of copies to be made, the number of originals, mode, sheet, magnification rate, copy density, and sorter mode are displayed on display portion A. When an user touches an item on display portion A, a picture plane for setting the details of the item, or a picture plane showing some warning is displayed.

Display portion B of FIG. 9 gives indication for inputting the number of copies and the number of originals for the first job.

The display portion B in FIG. 10 gives an indication for inputting the number of copies and the number of originals for the second job. The display portion B in the state shown in FIG. 10 indicates the number of copies and the number of originals that can be set for the second job as "possible range for the second job". The possible range for the second job includes a range in employing a sheet number priority mode and a range in employing a bin priority mode. The settings for the second job can be made by the user within the range indicated on this portion.

Figure 11:
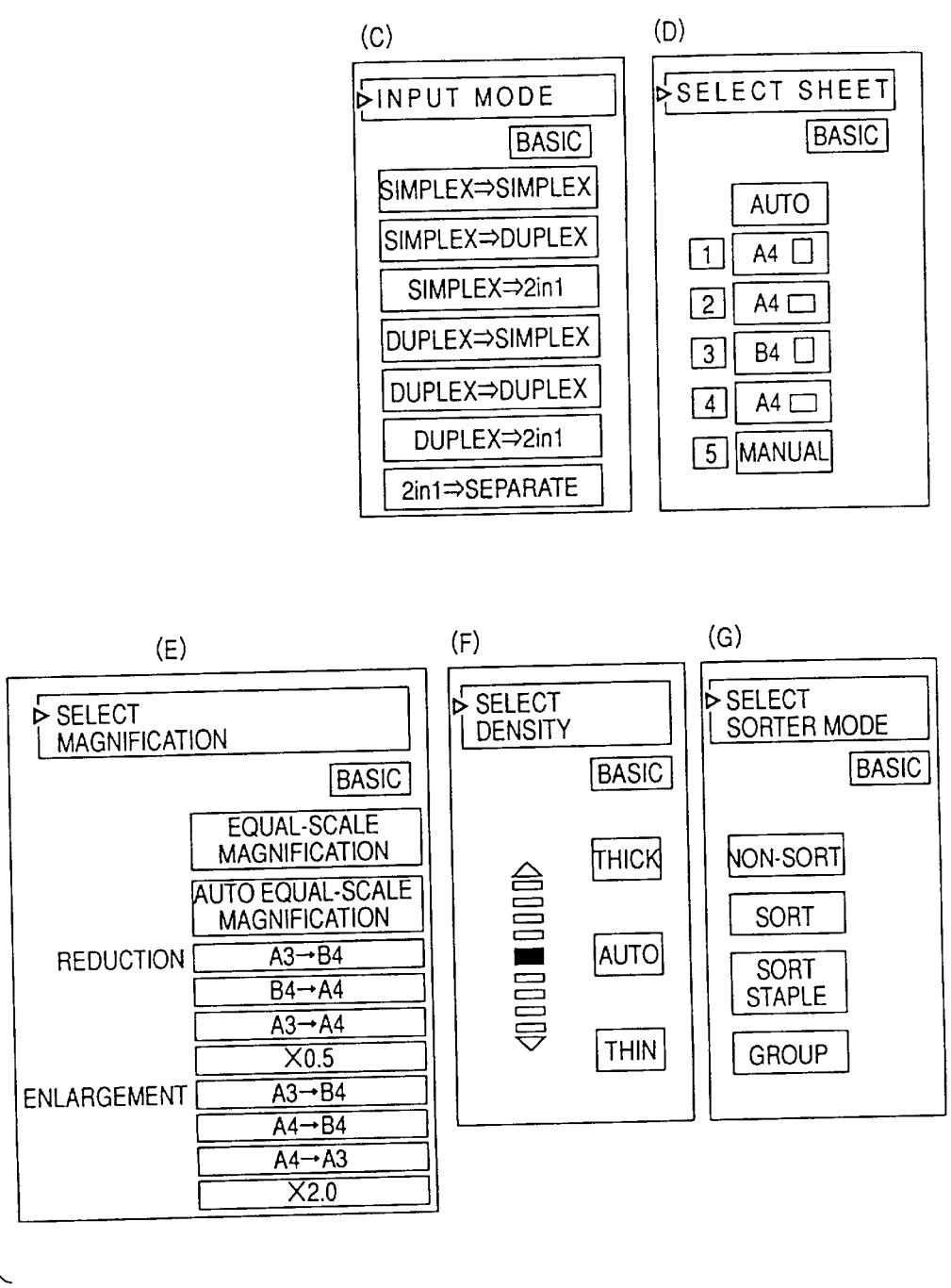
FIG. 11 shows a picture displayed by input after the state shown in FIG. 10.

When the user touches the portion of "MODE" of display portion A in the state shown by FIG. 9 or FIG. 10, a picture plane for setting the modes indicated on (C) of FIG. 11 is given on display portion B.

Similarly, when the user touches the portion of "SHEET" of display portion A, the picture plane shown in (D) of FIG. 11 is given on display portion B.

When the user touches the portion of "MAGNIFICATION" of display portion A, the picture plane shown in (E) of FIG. 11 is given on display portion B.

Touching of "COPY DENSITY" provides the picture plane shown in (F) of FIG. 11. Touching of "SORTER MODE" by the user gives the picture plane shown in (G) of FIG. 11.

(Control Block of Operation Panel Unit)

Figure 12:
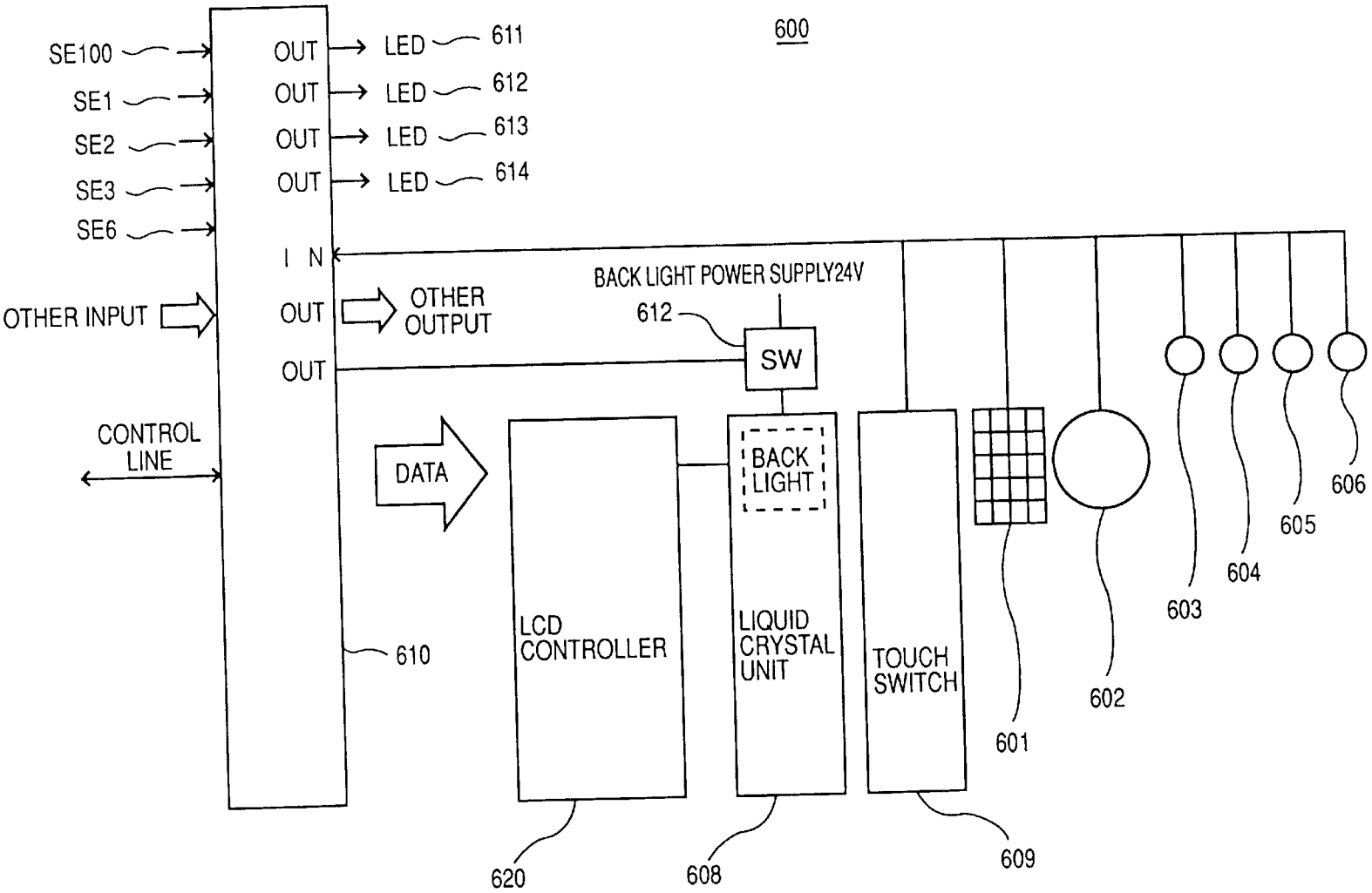
FIG. 12 is a block diagram showing a circuit which controls the operation panel unit.

FIG. 12 is a control block diagram of operation panel unit 600.

The control block includes: a microcomputer 610; liquid crystal display unit 608; an LCD controller 620 for controlling the liquid crystal display unit; a switch 612 for a back light which illuminates liquid crystal display unit 608; touch switch 609 provided on liquid crystal display unit 608; ten key 601; print key 602; stop key 603; all reset key 604; job switch key 605; and job succession key 606. Microcomputer 610 receives inputs from sensors SE100, SE1, SE2, SE3, SE6 and the other sensors.

Microcomputer 610 also controls LEDs 611–614.

Microcomputer (CPU) 610 controls operation panel unit 600, and transmits copying conditions set by an user or instructions concerning start of printing to a print head portion via a control line.

LCD controller 620 outputs data to liquid crystal display unit 608 according to the data supplied from CPU 610.

Liquid crystal display unit 608 provided with the back light which is turned on/off by switch 612 displays the key input picture plane according to a control signal supplied from LCD controller 620. The user touches and presses touch switch 609 in order to press an indicated portion of a key on liquid crystal display unit 608 through touch switch 609. Touch switch 609 is constituted by total three hundred switches arranged on the display picture plane with twenty of them in horizontal line and fifteen of them in vertical line. The data concerning the position of the switch pressed by the user is sent to CPU 610. CPU 610 recognizes the key pressed by the user based on the position data supplied from the touch switch and the key input picture plane shown on liquid crystal display unit 608.

The instruction of the user is given to CPU 610 by ten key 601 for inputting numeric values on the panel, print key 602 for starting copying operation, stop key 603 for temporarily stopping copying operation, all reset key 604 for initializing copying mode, job switch key 605 for switching between the first and second jobs, and job succession key 606 for inputting whether the first job and the second job are consecutive or not. Accordingly, CPU 610 provides a control signal to LCD controller 620 corresponding to recognized details of the keys in order to switch the content of display on liquid crystal display unit 608.

The light of LEDs 611 and 612 is turned on/off in accordance with turning on/off of job switch key 605, and the light of LEDs 613 and 614 is on/off in accordance with turning on/off of job succession key 606.

When ADF is operated, CPU receives signals from ADF open/close sensor SE100, the second tray document empty sensor SE1, the first tray document empty sensor SE2, pre-feeding paper empty sensor SE3, and the second tray home position detection sensor SE9, and controls the operation of ADF by other outputs.

(Control of Copying Machine)

Figure 13:
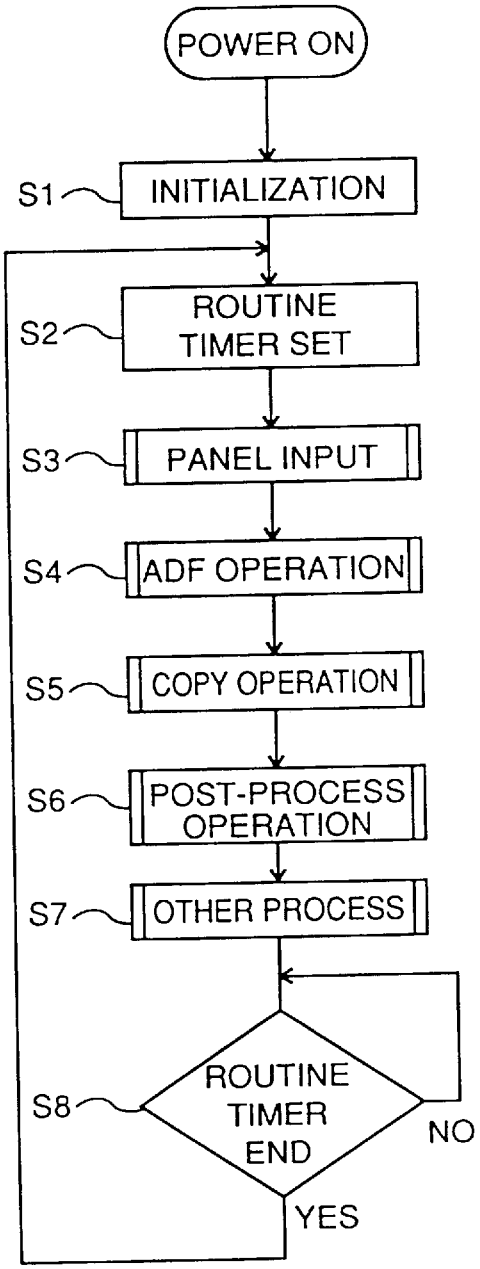
FIG. 13 shows a main routine of the copying machine shown in FIG. 1.

FIG. 13 shows a flow chart of a main routine for controlling the copying machine shown in FIG. 1.

Referring to the figure, when the power is turned on, the microcomputer is set to an initial state in step S1.

In step S2, a routine timer is set for making one cycle of the main routine to become constant, for example, 10 msec. In step S3, processes such as input of a key matrix of the operation panel or panel input are carried out. Details are given referring to FIG. 14.

In step S4, operation of ADF is proceeded. Copying operation is carried out in step S5. In step S6, post-processing operation is performed. The post-processing operation refers to such operations as stapling or aligning of the copied sheets.

In step S7, other processes (for example, trouble process, warning process, or the like) are carried out.

In step S8, completion of the timer set in step S2 is determined, and a process for making the period of one cycle of the routine to become constant is performed. After the processing in step S8, processings from step S2 are repeated.

Figure 14:
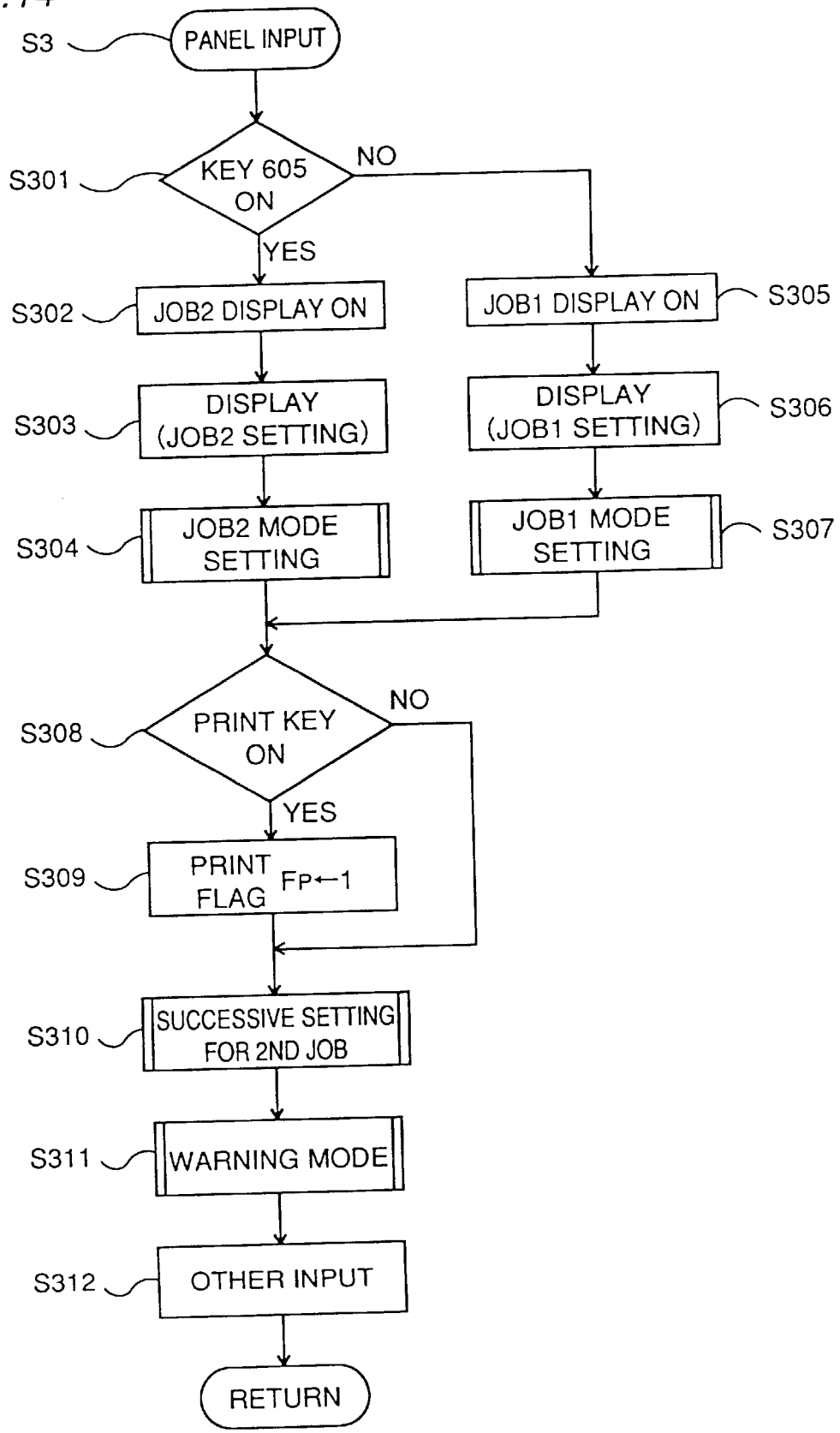
FIG. 14 is a flow chart showing a process performed in the panel input routine (S3) of FIG. 13.

FIG. 14 is a flow chart showing a subroutine of the panel input process (S3) in FIG. 13.

With reference to FIG. 14, whether job switch key 605 is turned on or off is determined in step S301. If YES (turned on), LED 612 is on in step S302, and the picture plane shown in FIG. 10 for setting the second job is displayed on the main panel in step S303. In step 304, input of the mode for the second job is made.

On the other hand, if NO in step S301, LED 611 is on in step S305, and the picture plane for setting the first job shown in FIG. 9 is displayed on main panel 607 in step S306. The mode for the first job is input in step S307.

In step S308, whether print key 602 is turned on or off is determined, and a print flag Fp is set to "1" if YES (turned on) in step S309. In step S310, a successive setting for the second job (details are given later) are made.

In step S311, the warning mode process is carried out for generating an alarming sound or the like. After a process for other inputs or the like is carried out in step S312, the operation returns to the main routine.

Figure 15:
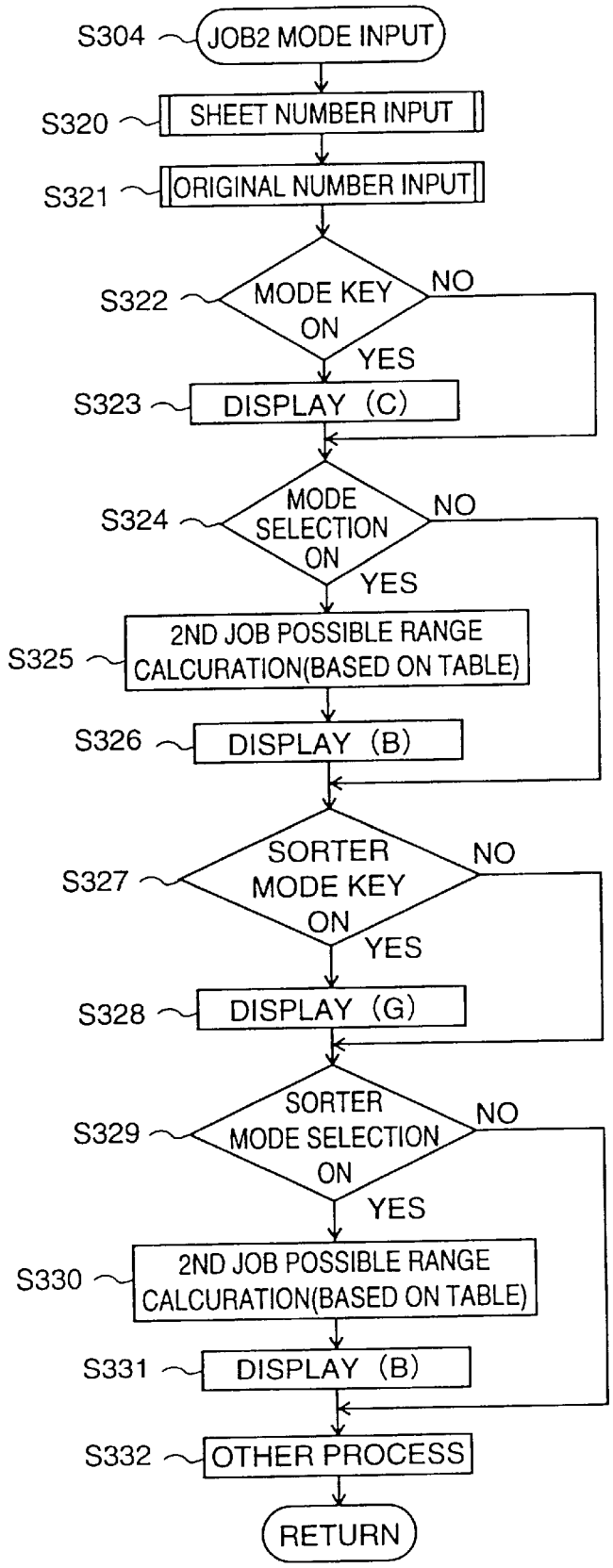
FIG. 15 is a flow chart showing a process performed in the second job mode input routine (S304) of FIG. 14.

FIG. 15 is a flow chart showing a subroutine of the second job mode input process in step S304 in FIG. 14.

With reference to FIG. 15, in step S320, the user inputs the number of copy sheets to be made using the display shown in FIG. 10. In step S321, the number of originals is similarly input.

The input number of copies and the number of originals have the maximum values set based on the number of copies and the number of originals processed in the first job. The maximum values are displayed at the bottom of display portion B as "possible range of the second job setting". The possible range of the second job setting varies depending on the sorter mode or the copy mode. Every time the mode is switched, the possible range of the second job is calculated again to be displayed on display portion B. As for the sorter mode, the user can make selection between (1) sorting mode and grouping mode, and between (2) bin priority mode and sheet number priority mode.

As for the copy mode, the user can select either of simplex→simplex copy mode, duplex→simplex copy mode, or simplex→duplex copy mode.

Figure 17:
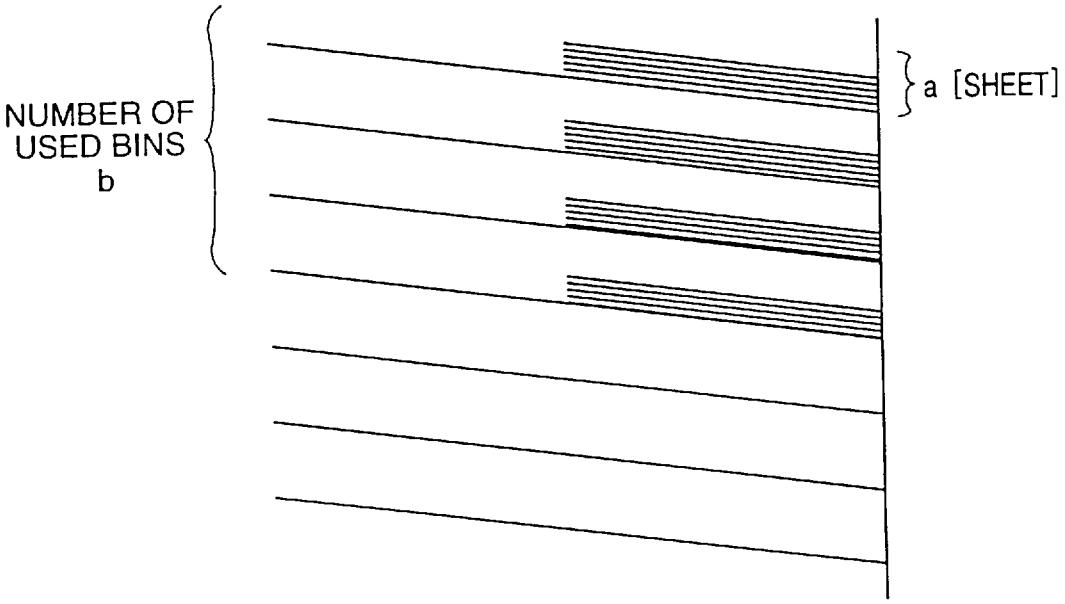
FIG. 17 shows a state after copying is performed when the number of copies is a and the number of original sheets is b in a grouping mode.

In the grouping mode, copied sheets are distributed among the bins according to each original. When the number of copies is "a", and the number of originals is "b", copying is carried out using "b" pieces of bins as shown in FIG. 17, and "a" sheets of copies are stocked in each of the bins.

Figure 18:
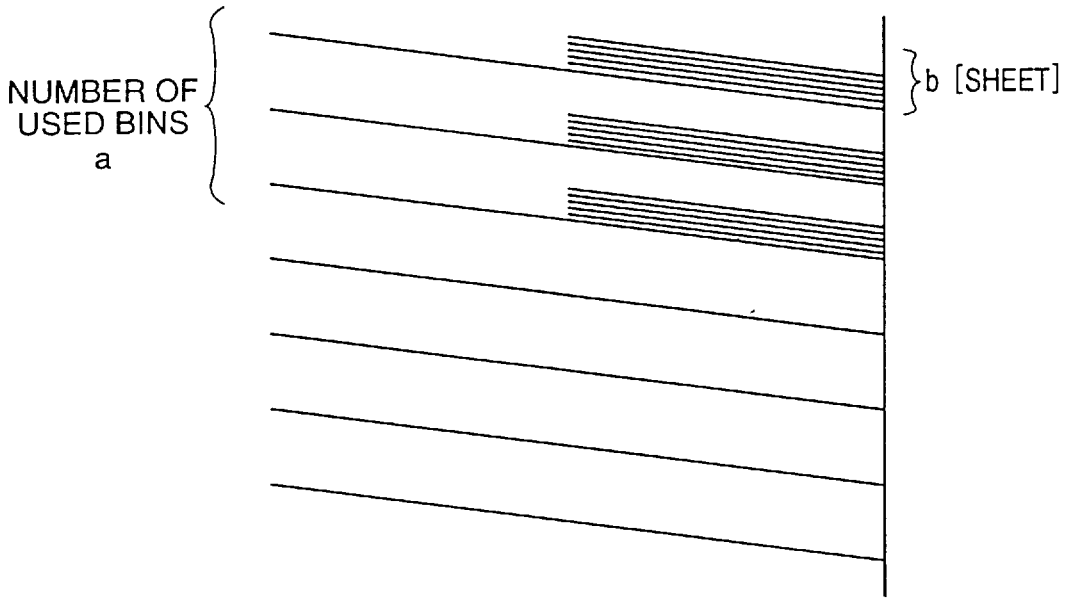
FIG. 18 shows a state after copying when the number of copies is a and the number of original sheets is b in a sorting mode.

In the sorting mode, the same copy sheets are distributed to respective bins. When the number of copies is "a" and the number of originals is "b", copying is carried out using "a" pieces of bins as shown in FIG. 18, and "b" sheets of copies are stocked in each of the bins.

Figure 19:
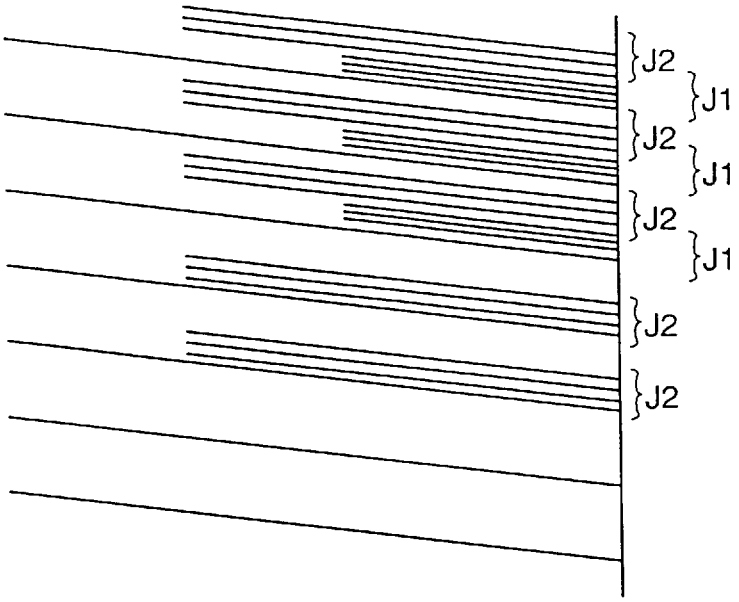
FIG. 19 shows a state after processes for the first and second jobs are completed in a bin priority mode.
Figure 20:
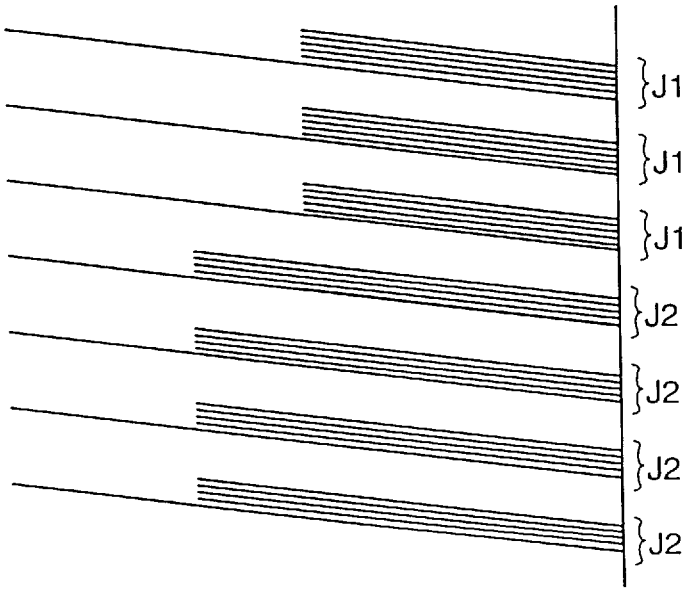
FIG. 20 shows a state after copying for the first and second jobs is carried out in a sheet number priority mode.

In the bin priority mode, the bin used for the first job is also used for the second job. In the sheet priority mode, the bin used for the first job is not used for the second job. In other words, in the bin priority mode, sheets for the second job J2 are stacked on sheets for the first job J1 on the sorter as shown in FIG. 19. On the other hand, in the sheet priority mode, sheets for the second job J2 and sheets for the first job J1 are distributed among respective sorters as shown in FIG. 20.

Figure 16:
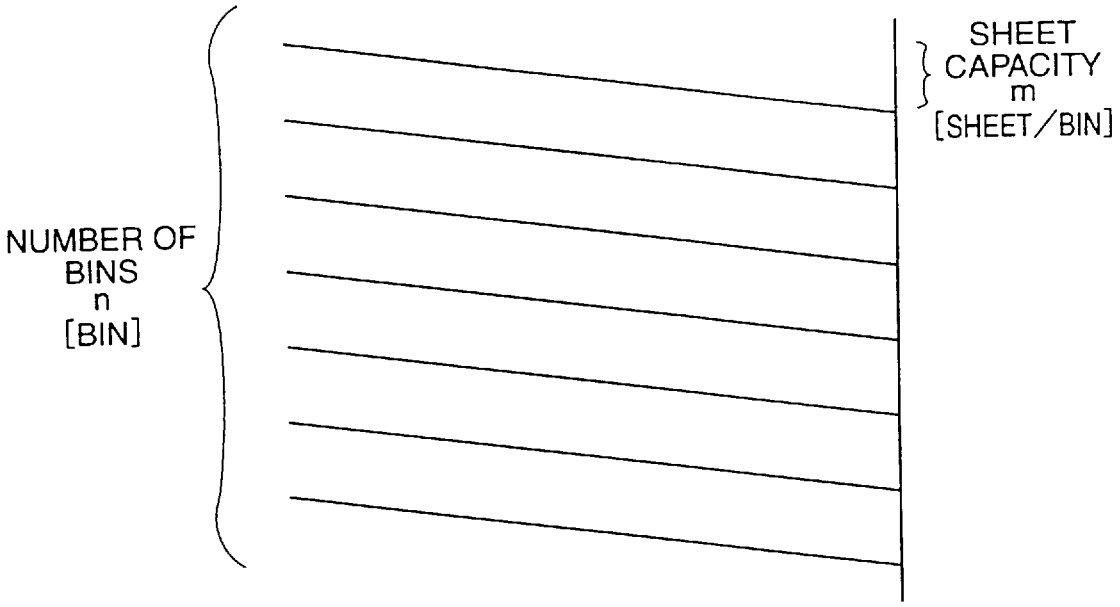
FIG. 16 is an illustration related to a sorter of the copying machine of FIG. 1.

As shown in FIG. 16, suppose that the number of sheets which can be contained in a single bin is m, the number of bins is n, the number of copies for the first job is a, and the number of originals is b, the possible range of the second job setting in the simplex→simplex copy mode is calculated as shown in the Table 1.

TABLE 1

| DISPLAY OF POSSIBLE RANGE (((CALCULATION FORMULA))) | | CAPACITY OF SORTER m (NUMBER OF SHEETS/BIN) n (BIN) ORIGINAL COPY SIMPLEX → SIMPLEX | | | | |
|---|---|---|---|---|---|---|
| FIRST JOB | | SECOND JOB | | | | |
| SORTER MODE | | SORTER MODE | | | GROUP | SORT |
| 1 GROUP | NUMBER OF COPIES a (SHEET) | 1 | BIN PRIORITY (USE ALL BINS) | NUMBER OF COPIES | m-a | n |
| | | | | NUMBER OF ORIGINALS | n | m-a |
| | NUMBER OF ORIGINALS b (BIN) | 2 | SHEET NUMBER PRIORITY STAPLE PRIORITY | NUMBER OF COPIES | m | n-b |
| | | | | NUMBER OF ORIGINALS | n-b | m |
| 2 SORT | NUMBER OF COPIES a (BIN) | 1 | BIN PRIORITY (USE ALL BINS) | NUMBER OF COPIES | m-b | n |
| | | | | NUMBER OF ORIGINALS | n | m-b |
| | NUMBER OF ORIGINALS b (SHEET) | 2 | SHEET NUMBER PRIORITY STAPLE PRIORITY | NUMBER OF COPIES | m | n-a |
| | | | | NUMBER OF ORIGINALS | n-a | m |
| 3 NON-SORT | NUMBER OF COPIES a (SHEET) | 1 | ALL MODES | NUMBER OF COPIES | m | n |
| | NUMBER OF ORIGINALS b (SHEET) | | | NUMBER OF ORIGINALS | n | m |

Similarly, the possible range of the second job setting in the duplex→simplex copy mode is calculated as shown in Table 2.

TABLE 2

ORIGINAL COPY
DUPLEX → SIMPLEX

| FIRST JOB | | SECOND JOB | | | | |
|---|---|---|---|---|---|---|
| SORTER MODE | | SORTER MODE | | | GROUP | SORT |
| 1 GROUP | NUMBER OF COPIES a (SHEET) | 1 | BIN PRIORITY (USE ALL BINS) | NUMBER OF COPIES | m-a | n |
| | | | | NUMBER OF ORIGINALS | n | m-a |
| | NUMBER OF ORIGINALS b (BIN) | 2 | SHEET NUMBER PRIORITY STAPLE PRIORITY | NUMBER OF COPIES | m | n-2b |
| | | | | NUMBER OF ORIGINALS | n-2b | m |
| 2 SORT | NUMBER OF COPIES a (BIN) | 1 | BIN PRIORITY (USE ALL BINS) | NUMBER OF COPIES | m-2b | n |
| | | | | NUMBER OF ORIGINALS | n | m-2b |
| | NUMBER OF ORIGINALS b (SHEET) | 2 | SHEET NUMBER PRIORITY STAPLE PRIORITY | NUMBER OF COPIES | m | n-a |
| | | | | NUMBER OF ORIGINALS | n-a | m |
| 3 NON-SORT | NUMBER OF COPIES a (SHEET) | 1 | ALL MODES | NUMBER OF COPIES | m | n |
| | NUMBER OF ORIGINALS b (SHEET) | | | NUMBER OF ORIGINALS | n | m |

The possible range of the second job setting in the simplex→duplex copy mode is calculated as shown in Table 3.

setting, after the copying is executed for the first job when the number of copies is 5 (sheets) and the number of originals is 8 (sheets), is shown below.

TABLE 3

ORIGINAL COPY
SIMPLEX → DUPLEX

| FIRST JOB | | SECOND JOB | | | | |
|---|---|---|---|---|---|---|
| SORTER MODE | | SORTER MODE | | | GROUP | SORT |
| 1 GROUP | NUMBER OF COPIES a (SHEET) | 1 | BIN PRIORITY (USE ALL BINS) | NUMBER OF COPIES | m-a | n |
| | | | | NUMBER OF ORIGINALS | n | m-a |
| | NUMBER OF ORIGINALS b (BIN) | 2 | SHEET NUMBER PRIORITY STAPLE PRIORITY | NUMBER OF COPIES | m | n-b/2 |
| | | | | NUMBER OF ORIGINALS | n-b/2 | m |
| 2 SORT | NUMBER OF COPIES a (BIN) | 1 | BIN PRIORITY (USE ALL BINS) | NUMBER OF COPIES | n-b/2 | n |
| | | | | NUMBER OF ORIGINALS | n | n-b/2 |
| | NUMBER OF ORIGINALS b (SHEET) | 2 | SHEET NUMBER PRIORITY STAPLE PRIORITY | NUMBER OF COPIES | m | n-a |
| | | | | NUMBER OF ORIGINALS | n-a | m |
| 3 NON-SORT | NUMBER OF COPIES a (SHEET) | 1 | ALL MODES | NUMBER OF COPIES | m | n |
| | NUMBER OF ORIGINALS b (SHEET) | | | NUMBER OF ORIGINALS | n | m |

Specifically, suppose that the number of sheets which can be contained in the sorter is 50 (sheets/bin), and the number of sorters is 20 (bins), the possible range of the second job The Tables 4, 5 and 6 respectively show those cases of simplex→simplex copy mode, duplex→simplex copy mode, and simplex→duplex copy mode.

TABLE 4

| DISPLAY OF POSSIBLE RANGE (((CALCULATION FORMULA))) | | CAPACITY OF SORTER 50 (NUMBER OF SHEETS/BIN) 20 (BINS) | | | | |
|---|---|---|---|---|---|---|
| | | ORIGINAL COPY SIMPLEX → SIMPLEX | | | | |
| FIRST JOB | | SECOND JOB | | | | |
| SORTER MODE | | SORTER MODE | | | GROUP | SORT |
| 1 GROUP | NUMBER OF COPIES 5 (SHEETS) | 1 | BIN PRIORITY (USE ALL BINS) | NUMBER OF COPIES | 45 | 20 |
| | | | | NUMBER OF ORIGINALS | 20 | 45 |
| | NUMBER OF ORIGINALS 8 (BINS) | 2 | SHEET NUMBER PRIORITY (USE 50 SHEETS) STAPLE PRIORITY | NUMBER OF COPIES | 50 | 12 |
| | | | | NUMBER OF ORIGINALS | 12 | 50 |
| 2 SORT | NUMBER OF COPIES 5 (BINS) | 1 | BIN PRIORITY (USE ALL BINS) | NUMBER OF COPIES | 42 | 20 |
| | | | | NUMBER OF ORIGINALS | 20 | 42 |
| | NUMBER OF ORIGINALS 8 (SHEETS) | 2 | SHEET NUMBER PRIORITY (USE 50 SHEETS) STAPLE PRIORITY | NUMBER OF COPIES | 50 | 42 |
| | | | | NUMBER OF ORIGINALS | 42 | 50 |
| 3 NON-SORT | NUMBER OF COPIES 5 (SHEETS) NUMBER OF ORIGINALS 8 (SHEETS) | 1 | ALL MODES | NUMBER OF COPIES | 50 | 20 |
| | | | | NUMBER OF ORIGINALS | 20 | 50 |

TABLE 5

| | | | | | | |
|---|---|---|---|---|---|---|
| | | ORIGINAL COPY DUPLEX → SIMPLEX | | | | |
| FIRST JOB | | SECOND JOB | | | | |
| SORTER MODE | | SORTER MODE | | | GROUP | SORT |
| 1 GROUP | NUMBER OF COPIES 5 (SHEETS) | 1 | BIN PRIORITY (USE ALL BINS) | NUMBER OF COPIES | 45 | 20 |
| | | | | NUMBER OF ORIGINALS | 20 | 45 |
| | NUMBER OF ORIGINALS 8 (BINS) | 2 | SHEET NUMBER PRIORITY (USE 50 SHEETS) STAPLE PRIORITY | NUMBER OF COPIES | 50 | 4 |
| | | | | NUMBER OF ORIGINALS | 4 | 50 |
| 2 SORT | NUMBER OF COPIES 5 (BINS) | 1 | BIN PRIORITY (USE ALL BINS) | NUMBER OF COPIES | 34 | 20 |
| | | | | NUMBER OF ORIGINALS | 20 | 34 |
| | NUMBER OF ORIGINALS 8 (SHEETS) | 2 | SHEET NUMBER PRIORITY (USE 50 SHEETS) STAPLE PRIORITY | NUMBER OF COPIES | 50 | 42 |
| | | | | NUMBER OF ORIGINALS | 42 | 50 |
| 3 NON-SORT | NUMBER OF COPIES 5 (SHEETS) NUMBER OF ORIGINALS 8 (SHEETS) | 1 | ALL MODES | NUMBER OF COPIES | 50 | 20 |
| | | | | NUMBER OF ORIGINALS | 20 | 50 |

60

TABLE 6

ORIGINAL COPY
SIMPLEX → DUPLEX

| FIRST JOB | | SECOND JOB | | | | |
|---|---|---|---|---|---|---|
| SORTER MODE | | SORTER MODE | | | GROUP | SORT |
| 1 GROUP | NUMBER OF COPIES 5 (SHEETS) | 1 | BIN PRIORITY (USE ALL BINS) | NUMBER OF COPIES | 45 | 20 |
| | | | | NUMBER OF ORIGINALS | 20 | 45 |
| | NUMBER OF ORIGINALS 8 (BINS) | 2 | SHEET NUMBER PRIORITY (USE 50 SHEETS) STAPLE PRIORITY | NUMBER OF COPIES | 50 | 16 |
| | | | | NUMBER OF ORIGINALS | 16 | 50 |
| 2 SORT | NUMBER OF COPIES 5 (BINS) | 1 | BIN PRIORITY (USE ALL BINS) | NUMBER OF COPIES | 46 | 20 |
| | | | | NUMBER OF ORIGINALS | 20 | 46 |
| | NUMBER OF ORIGINALS 8 (SHEETS) | 2 | SHEET NUMBER PRIORITY (USE 50 SHEETS) STAPLE PRIORITY | NUMBER OF COPIES | 50 | 42 |
| | | | | NUMBER OF ORIGINALS | 42 | 50 |
| 3 NON-SORT | NUMBER OF COPIES 5 (SHEETS) NUMBER OF ORIGINALS 8 (SHEETS) | 1 | ALL MODES | NUMBER OF COPIES | 50 | 20 |
| | | | | NUMBER OF ORIGINALS | 20 | 50 |

Returning to FIG. 15, when a mode key of display portion A in FIG. 10 is turned on in step S322, display of (C) of FIG. 11 is given in step S323. When mode selection is made for (C) of FIG. 11 in step S324, the possible range of the second job setting is calculated again according to the method of calculation indicated in the Tables 1–3 in step S325. In step S326, display of picture plane B in FIG. 10 is given, and the values obtained by the calculation of the possible range of the second job setting are displayed at the bottom part of display portion B.

When the sorter mode key on display portion A in FIG. 10 is turned on in step S327, display of (G) of FIG. 11 is given in step S328.

When sorter mode selection is made for (G) of FIG. 11 in step S329, the possible range of the second job setting is calculated according to the method of calculation shown in the Tables 1–3 in step S330. In step S331, (B) of FIG. 10 is again displayed, and the values calculated as the possible range of the second job setting are indicated.

In step S332, other processes are carried out and the procedure returns to the routine of the panel input.

Figure 21:
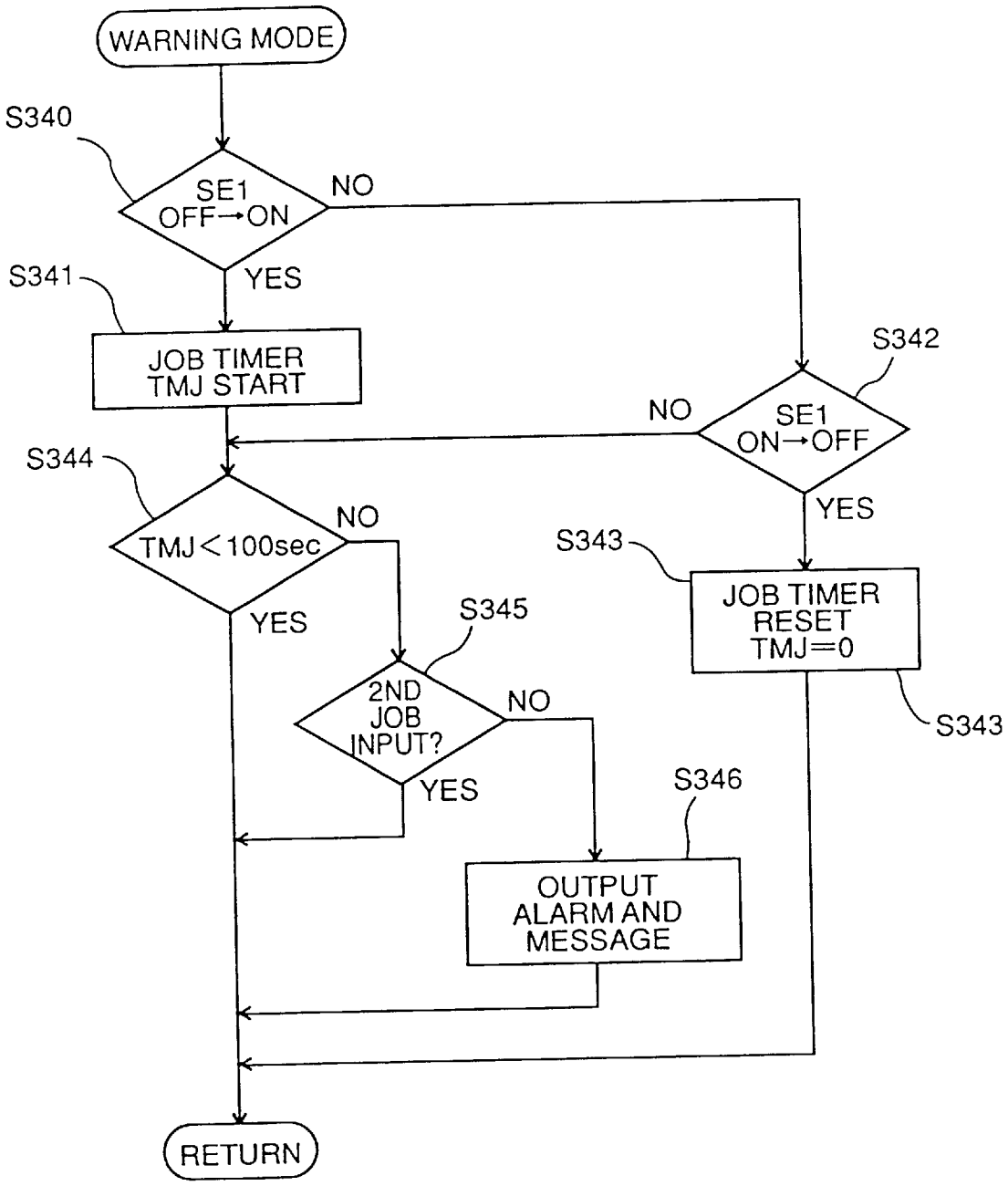
FIG. 21 shows a flow chart of a process in a warning mode routine (S311) of FIG. 14.

FIG. 21 is a flow chart showing the processings in a subroutine of the warning mode in step S311 in FIG. 14.

In this routine, an alarming sound or a message is output unless inputs of the second job settings are provided during a prescribed time after an original for the second job is set, so that input of settings for the second job is urged. A reset process is also provided when some papers are removed in the middle of the routine.

When it is detected that the second job set detection sensor SE1 of FIG. 7 becomes on from the off state in step S340, a job timer TMJ is started in step S341.

If the transition from the turning off to the turning on state is not detected in step S340, it is determined whether the transition from turning on to turning off state is detected by the second job set detection sensor SE1 in step S342. If YES in step S342, job timer TMJ is reset in step S343, and the procedure returns to the panel input routine. The processing in step 342 corresponds to the process performed when some papers for the second job are removed in the middle of the operation.

After the processing in step S341, if it is determined that a certain time (e.g. 100 seconds) has not passed in the job timer in step S344 (YES in S344), the operation returns to the panel input routine as it is.

Figure 22:
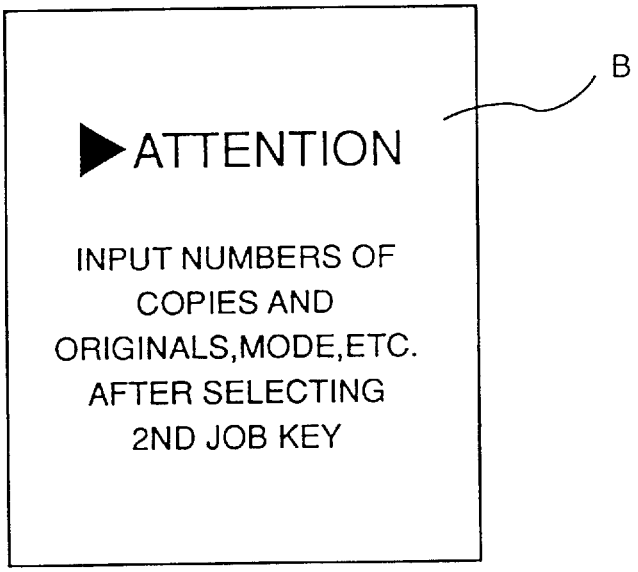
FIG. 22 specifically shows a warning message indicated in step S346 of FIG. 21.

If it is determined that more than a certain time has passed in the job timer in step S344, whether an input for the second job is provided or not is determined in step S345. If YES in step S345, the operation returns to the panel input routine. If NO in step S345, a warning message shown in FIG. 22 is provided on display portion B, and an alarming sound is output simultaneously. The process thereafter proceeds to the panel input routine.

Figure 23:
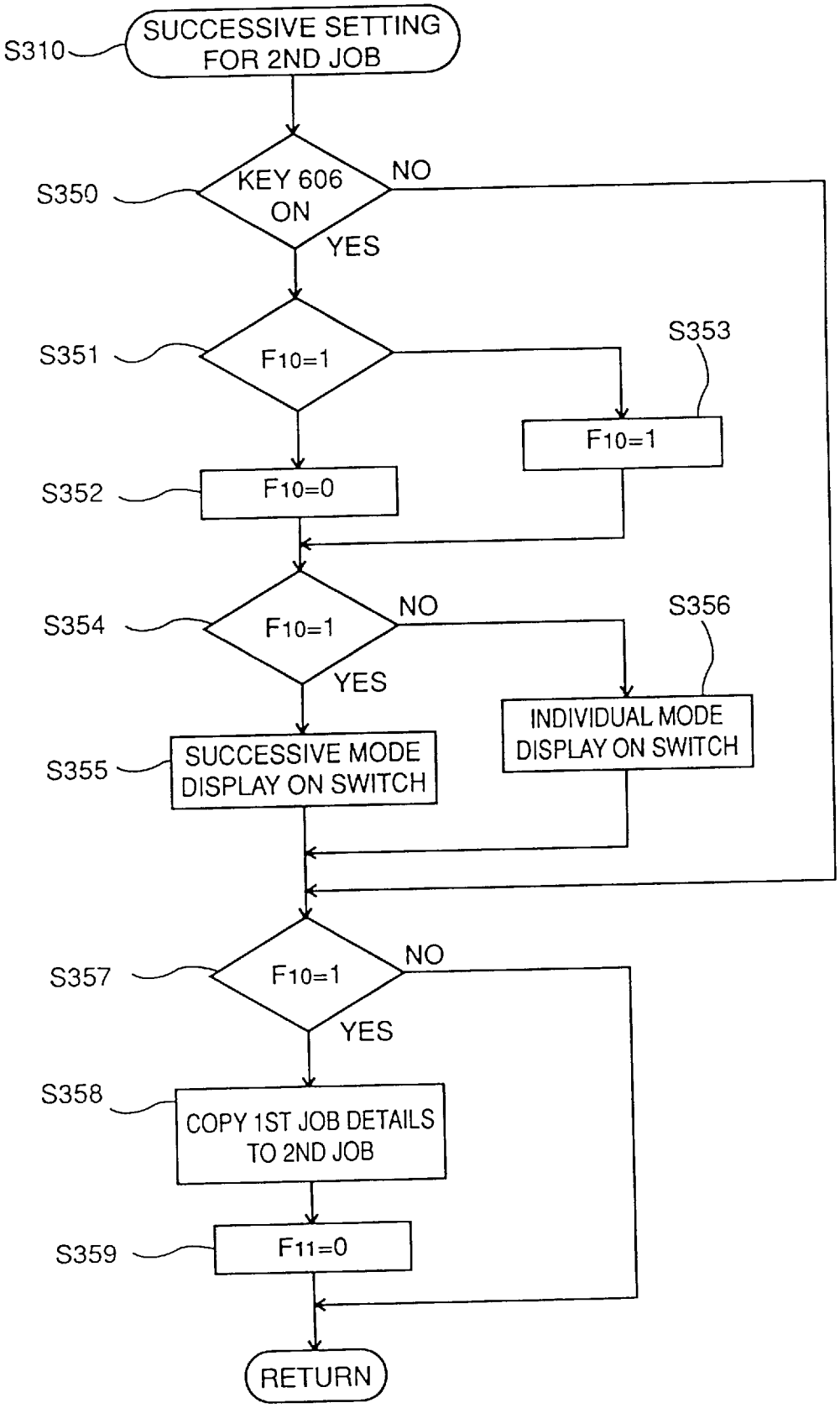
FIG. 23 is a flow chart showing a process in successive setting for the second job (S310) of FIG. 14.

FIG. 23 is a flow chart showing the process of the subroutine of the successive setting for the second job in step S310 in FIG. 14.

With reference to FIG. 23, determination is made as to whether job succession key 606 is pressed or not in step S350. If YES in step S350, determination is made as to a flag $F_{10}$ of job succession key 606 is "1" or not in step S351.

If YES in step S351, flag $F_{10}$ is set to "0" in step S352. If NO, flag $F_{10}$ is set to "1" in step S353.

Whether flag $F_{10}$ is "1" or not is determined in step S354, and LED 613 for displaying succession mode is lit in step S355. If NO, LED 614 for displaying individual mode is lit in step S356.

In step S357, whether flag $F_{10}$ is "1" or not is determined. If YES, process for succession mode is executed in step S358. Specifically, details of the settings of the number of copies, the number of originals or the like for the first job are copied to those for the second job. Stapling process (post-process) for the first job is inhibited by setting a first job stapling flag $F_{11}$ to "0" which is used for setting whether stapling process should be proceeded or not in the first job.

The process in step S359 forces the stapling process not to be executed at the time of completion of the first job. Accordingly, stapling operation after the second job is completed can be proceeded in the mode set in the first job.

On the other hand, if flag $F_{10}$ is "0" in step S357, processes in steps S358 and S359 are not proceeded and the operation returns to the main routine in order to individually execute the processes for the first and second jobs.

If NO in step S350, processes are carried out starting from step S357.

Through the processes shown in FIG. 23, a group of originals next to a group of originals for the first job can be set by the user as the second job when the succession job mode is set by job succession key 606. After the copy process of the first job is completed, post-process (stapling operation) of the copied sheets is not carried out until the copying process for the second job is completed. Accordingly, the first job and the second job can be processed successively, so that handling of the apparatus is improved.

When the succession mode is set, the user sets originals successively for the first job and the second job. Details are shown in FIG. 24.

Figure 24:
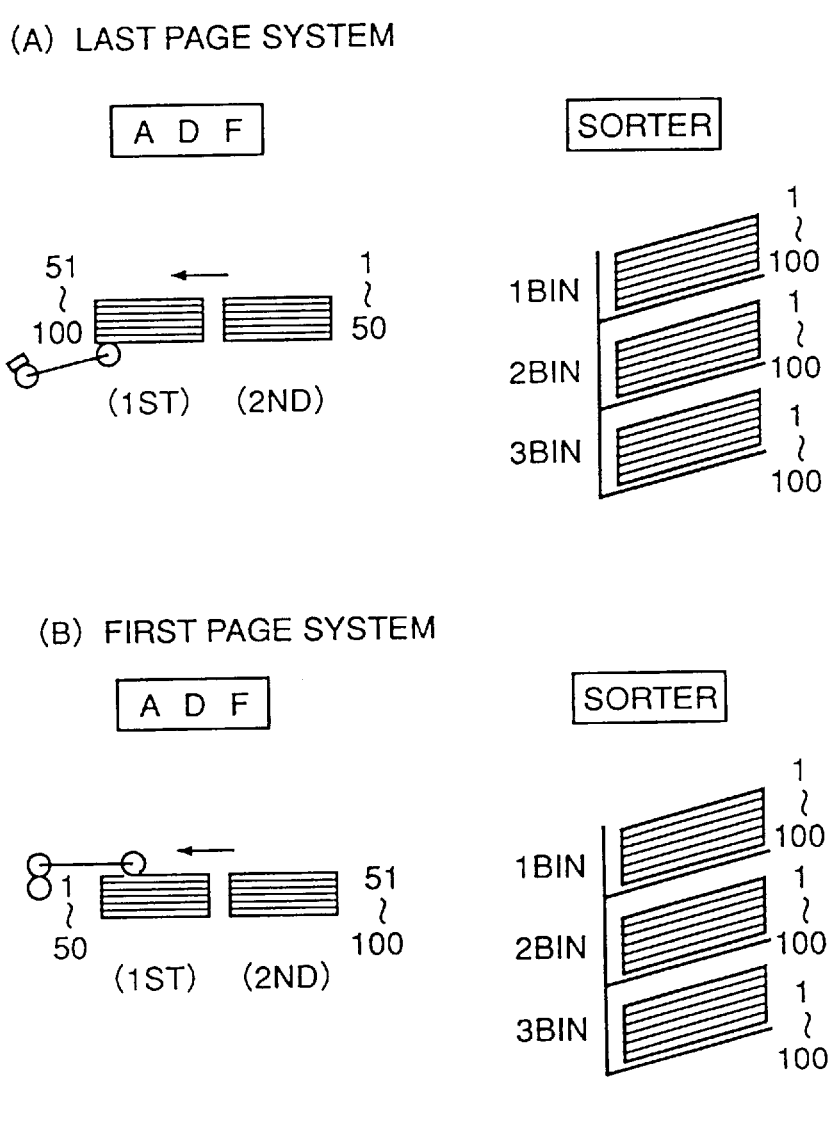
FIG. 24 is an illustration related to a method of loading original documents at ADF in the successive job settings.

Referring to FIG. 24, if the last page system of (A) is employed in a copying machine, the user sets the latter half of successive originals in order from the top for the first job. The user sets the former half of the successive originals in order from the top for the second job. Specifically, when successive originals are constituted by pages 1 to 100, originals of pages 1 to 50 are set in order from the top for the second job, and originals of pages 51 to 100 are set in order from the top for the second job. Accordingly, as shown in (A) in the figure, after copy sheets of pages 1 to 100 from the top are placed on each bin of the sorter, post-processing such as stapling is carried out.

On the other hand, when the first page system is employed in a copying machine, the user sets the former half of a group of successive originals in order from the top for the first job, and the latter half of them in order from the top for the second job as shown in (B) of FIG. 24. Specifically, if the group of originals is constituted by pages 1 to 100, originals of pages 1 to 50 are set from the top in order for the first job, and originals of pages 51 to 100 are set in order from the top for the second job.

In this case, after originals of pages 1 to 100 from the top is supplied onto each bin of the sorter as shown in (B) of the figure, post-processing such as stapling is carried out.

Although the way of placing originals is different depending on whether the last page system or the first page system is employed, the control can be made similarly for both of the systems employed.

(Operation of ADF)

Figure 25:
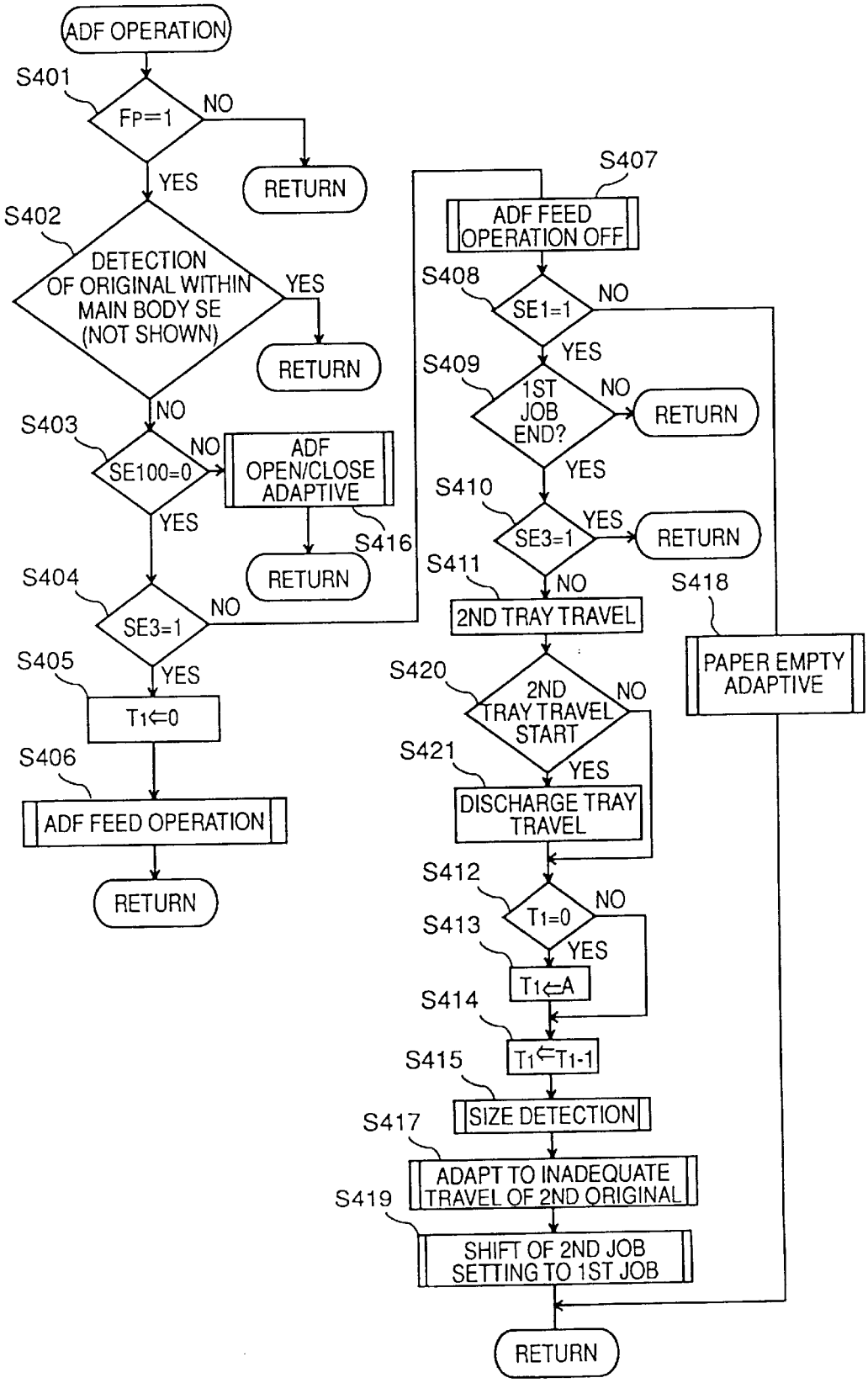
FIG. 25 is a flow chart for an operation of ADF.

FIG. 25 is a flow chart related to the operation of ADF.

Referring to FIG. 25, whether a print flag Fp is "1" or not is determined in order to judge if print operation is to be executed or not. If NO, processing in this operation is completed.

If YES in step S401, presence of a manually placed original is determined by judging whether the original detection sensor SE set within a copying machine (not shown) is turned on or not in step S402. This process is provided to prevent the operation of ADF if there is a manually placed original. If YES, processing in this operation is completed.

If NO in step S402, whether ADF open/close sensor SE100 is "0" or not is determined in step S403. If YES in step S403, whether paper empty sensor SE3 of paper feed unit is "1" or not is determined in order to judge presence of an original in the first tray feed unit in step S404.

If YES in step S404, the second tray travel timer $t_1$ is reset to "0" in step S405. In step S406, ADF paper feed operation is started and the operation return to the main flow.

If NO in step S404, paper feed operation routine of ADF is started and the operation is held for a certain time in step S407.

In step S408, whether sensor SE1 is "1" or not is determined in order to judge if an original is placed on the second tray. If an original is placed on the second tray, SE1 becomes "1", and the operation proceeds to the processing for the second job. Sensor SE1 is mounted on the second tray and moves simultaneously with the second tray. Accordingly, removal of an original by an user during traveling of the tray on the second tray can be detected. A plurality of sensors may be provided for detecting the presence of an original wherever the second original is positioned.

If YES in step S408, completion of the first job is determined in step S409. Completion of the first job refers to either of the four time points indicated in the following (1) to (4). By selecting either of (1), (2) or (4) as completion time point out of the four time points (1) to (4) used for determining the completion, movement of the second tray is started during post-processing operation of the first job, resulting in improved productivity.

(1) There is no original on the first tray of ADF.

(2) Copy sheets for the first job are discharged from the main body of the copying machine.

(3) Post-processing of the copy sheets such as stapling is fully completed.

(4) A timing set such that copy sheets for the second job are discharged to a bin immediately after completion of post-processing for the first job.

It is possible to select the most preferable one from (1) to (4) described above in order to set it as a time point of completion of the first job according to easiness to process at the time of paper jam, objects such as improvement of the system structure or productivity.

If NO in step S409, processes in this routine are completed. If YES, presence of an original at a paper feed entrance of ADF is determined by sensor SE3 set to "1" in step S410. After completion of the first job, sensor SE3 becomes "1" if there is an original for interruption till the second job is set. And the procedure returns to the main flow in order to preferentially process the interrupted original. If there is no original, the second tray is moved in the direction toward the paper feed entrance in step S411.

If originals for the first and second jobs are both discharged to the same discharge tray, both of the groups of originals are mixed. Therefore, the discharge tray is shifted by the shift block and an operation for dividing both of the groups of originals is started.

Specifically, when starting of the movement of the second tray is detected in step S420, the discharge tray is shifted by the shift block in order to move the discharged originals for the first job and to offset the tray from the position for discharging originals for the second job to be proceeded in step S421.

In step S412, it is determined whether second tray travel timer $t_1$ which was reset when there was no original for the first job on the first tray is "0" or not.

If YES, a time A for detecting jam process is substituted for timer $t_1$ in step S413. If NO, there is no substitution.

In step S414, 1 is subtracted from timer $t_1$ substituted with A, every time a single cycle routine is completed. The subtracted value is substituted for the value $t_1$ of the timer.

Time A for detecting jam process is a value generated by adding an arbitrary time allowance to the time required from the start of the movement of the second tray having an original set thereon till placement of the second tray at ADF paper feed unit. The value is set according to the value which is set corresponding to the size of an original detected by the original size detection unit. When the second tray continues to move for a time period exceeding the value A, occurrence of a trouble is determined in step S417 described below.

The size of an original is detected in step S415. In S417, a process applied when an original for the second job is not correctly moved is carried out. Details are given with reference to FIG. 27.

In step S419, a shifting process of the second job setting to the first job setting is carried out. The process is also described below.

If NO in step S408, there is no original on the second tray. In step S418, a process corresponding to a paper empty state is proceeded. This process is also described below.

If NO in step S403, ADF open/close adaptive routine is executed in step S416.

Figure 26:
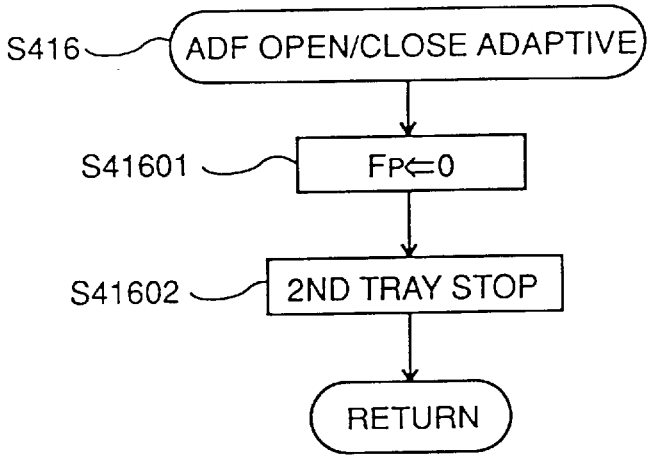
FIG. 26 is a flow chart showing a process in a ADF open/close adaptive routine (S416) of FIG. 25.

FIG. 26 is a flow chart showing specific processes in the ADF open/close adaptive routine (S416) in FIG. 25.

These processes are provided for inhibiting movement of the tray for the second job when ADF is opened during job processing. More specifically, after print flag Fp is set to "0" in step S41601 and movement of the second tray is stopped in step S41602, this routine returns to the main flow.

Figure 27:
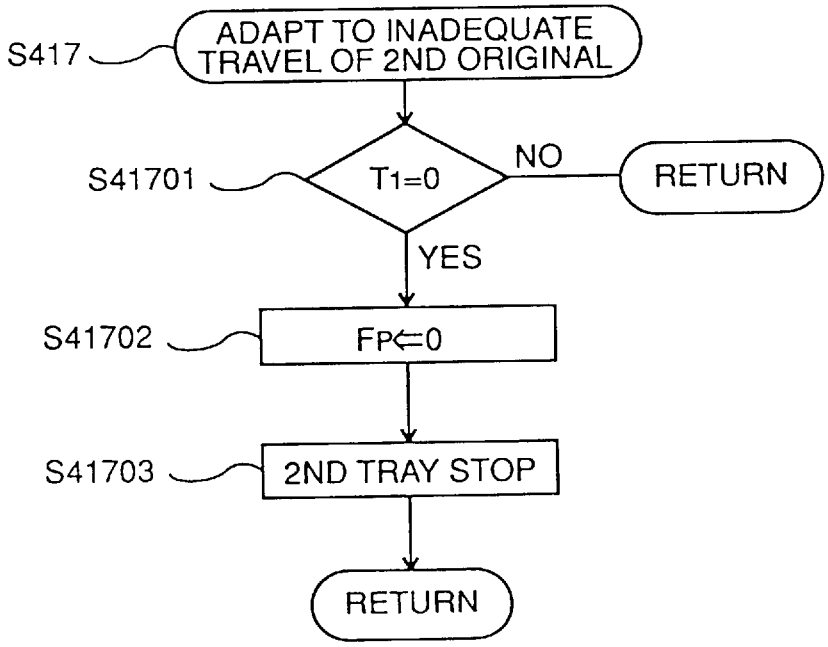
FIG. 27 is a flow chart showing a process in a routine adapted to inadequate travel of the second document (S417) of FIG. 25.

FIG. 27 is a flow chart showing specific processes in the routine adapted to inadequate travel of the second document (S417) in FIG. 25.

These processes are carried out for handling a case in which some abnormality occurs during the travel of the original for the second job.

Referring to FIG. 27, it is determined whether the second tray travel time timer $t_1$ counted down in the steps S412, S413 and S414 is "0" or not in step S41701.

If YES in step S41701, print flag Fp is set to "0" in step S41702. In step S41703, travel of the second tray is stopped.

If NO in step S41701, the routine returns to the main routine.

If the trouble described above is detected, a warning message is output on the panel in step S7 in FIG. 13.

Figure 28:
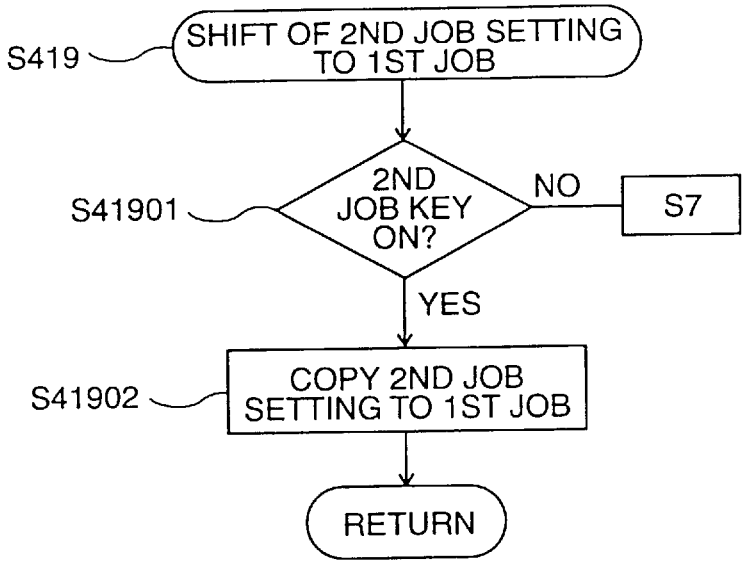
FIG. 28 is a flow chart showing a process in a routine for shifting the second job setting to the first job (S419) of FIG. 25.

FIG. 28 is a flow chart showing details of the routine for shifting the second job setting to the first job (S419) in FIG. 25.

In this process, the content of the second job is set as the content of the first job.

In step S41901, whether the second job key is ON or not is determined.

If YES in step S41901, the setting of the second job is copied to the setting of the first job in step S41902 when the second job is processed.

If NO in step S41901, the process proceeds to step S7 in FIG. 13, and warning process for urging setting of the second job is carried out in the warning routine.

Figure 29:
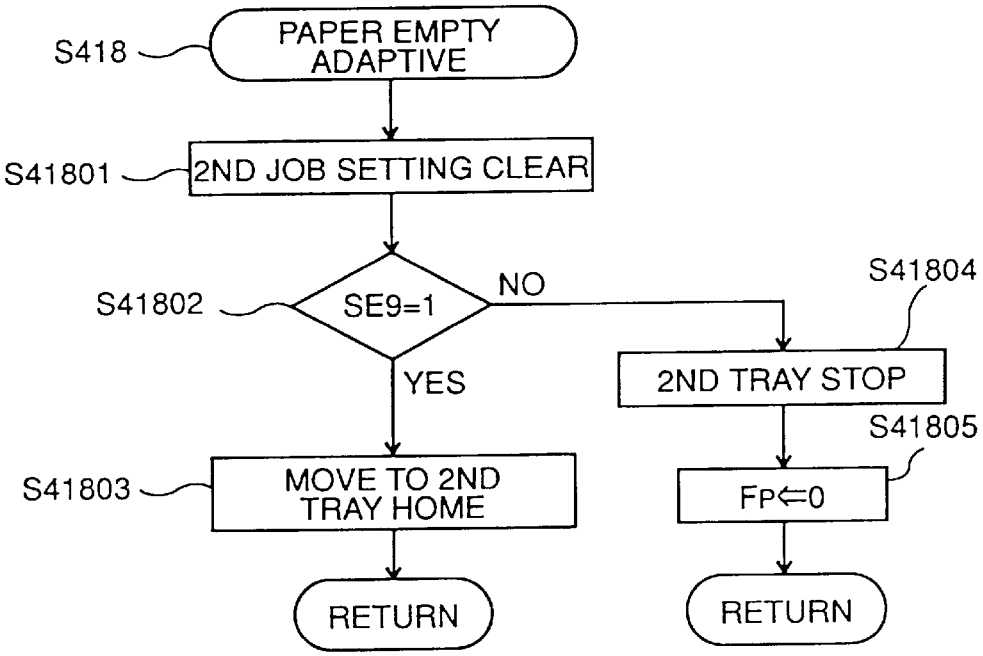
FIG. 29 is a flow chart showing a process in a paper empty adaptive routine (S418) of FIG. 25.

FIG. 29 is a flow chart showing details of the paper empty adaptive routine (S418) in FIG. 25.

This process is carried out in the second job at the time of paper empty.

Referring to FIG. 29, when it is detected that the sensor SE3 of the first tray is "0" indicating absence of an original (NO in S404), setting of the second job is canceled (cleared) in step S41801 if sensor SE1 of the second tray is "0".

Accordingly, setting of the second job and placement of an original can be carried out again until the first tray has no original. When an original set for the second job is removed by an user during travel of the second tray, whether the second tray home position detection sensor SE9 is "1" or not is determined in step S41802. If NO, the second tray is transported to its home position in step S41803.

If the second tray returns to the home position (YES in S41802), the second tray is stopped in step S41804, and print flag Fp is set to "0" in step S41805.

After the second tray is transported to the paper feed portion in the second job, the second tray is stopped there until the second job is completed and returned to the home position after completion of the second job.

When a successive multi-job is carried out (the third or more jobs are carried out), control should be provided such that the second tray returns to the home position after a certain time from the time when the pre-feeding paper empty sensor SE3 becomes "1".

(Post-Processing Operation)

Figure 30:
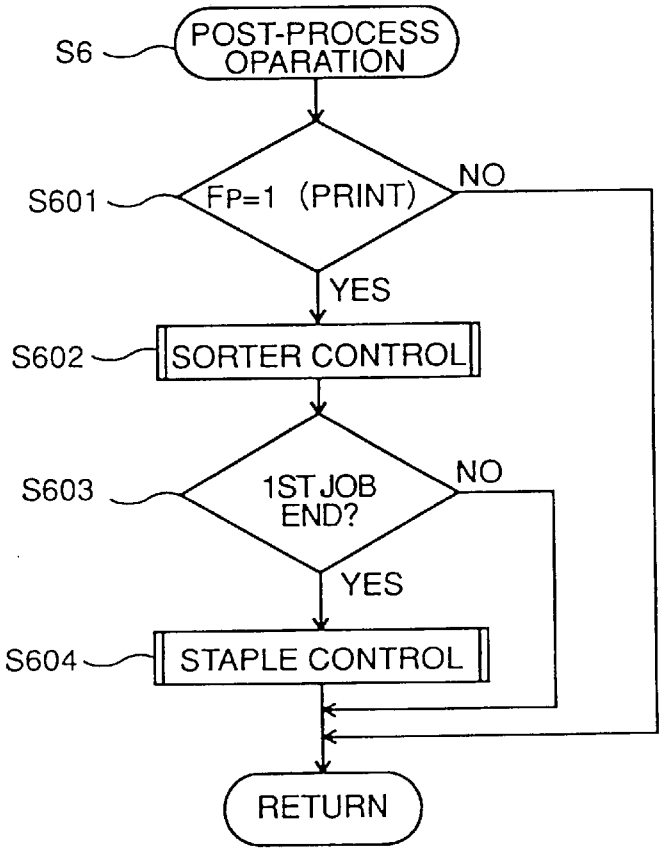
FIG. 30 is a flow chart showing a process in a post-process operation routine (S6) of FIG. 13.

FIG. 30 is a flow chart showing the processing in the post-processing operation (S6) in FIG. 13.

With reference to FIG. 30, whether print flag Fp is "1" or not is determined in step S601. If YES, control of the sorter is carried out in step S602.

In step S603, whether the first job is completed or not is determined. If YES, stapling process is executed in step S604. At this time, if the first job stapling flag $F_{11}$ is "0", no stapling process is performed in the first job.

It is noted that determination of the completion of the first job is made similarly to the determination in step S409 in FIG. 25.

If the answer is NO in step S601 or S603, this process is completed.

Figure 31:
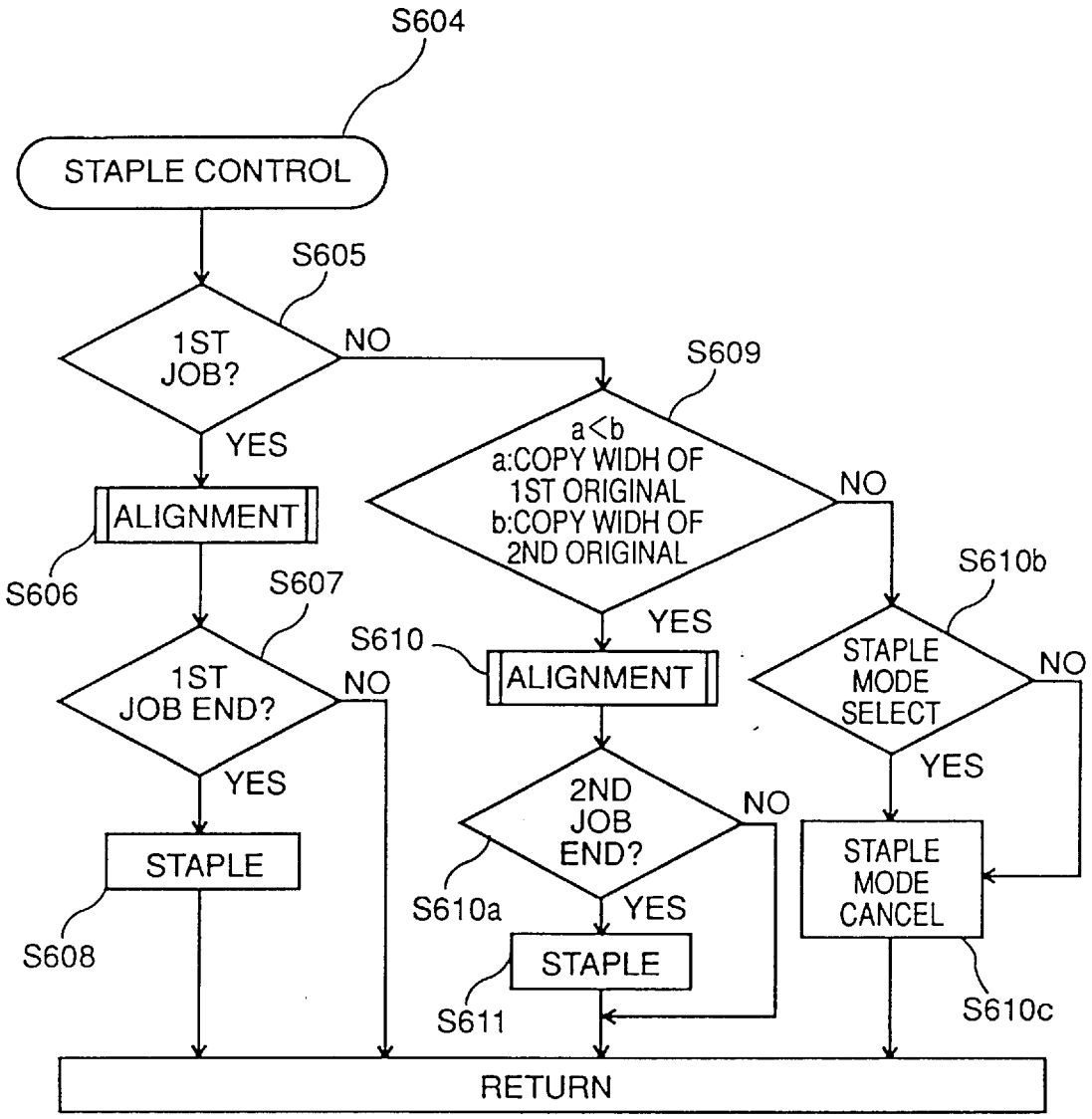
FIG. 31 is a flow chart showing a process in a stapler control routine (S604) of FIG. 30.

FIG. 31 is a flow chart showing processing in the stapling control routine (S604) in FIG. 30.

The copying machine according to this embodiment is characterized in that the alignment and stapling processes are carried out only when the width of a copy of an original for the first job is smaller than that for the second job if copy sheets for the first and second jobs are discharged to the same bin.

With reference to FIG. 31, whether it is the first job or not is determined in step S605. If YES, alignment is performed by the alignment unit in step S606. Whether the first job is completed or not is determined in step S607. If YES, stapling process is carried out only when the stapling flag $F_{11}$ for the first job is not "0" in step S608, and this process is completed. If NO in step S607, this process is completed.

If NO in step S605, whether the width of the copy sheet for the first job "a" is smaller than that for the second job "b" is determined in step S609. If YES, alignment process is proceeded in step S610. In step **S610*a***, whether the second job is completed or not is determined.

If YES in step **S610*a*, stapling process is performed in step S611**, and the process is completed.

If NO in step **S610*a***, this process is completed.

If NO in step S609, if the stapling mode is selected or not is determined in step **S610*b*. If selected, the stapling mode is canceled in step S610*c*** and the process is brought to an end.

The reason why the alignment and stapling processes are carried out only when the width of the copy sheet for the second job is larger than that for the first job is as follows.

Figure 32:
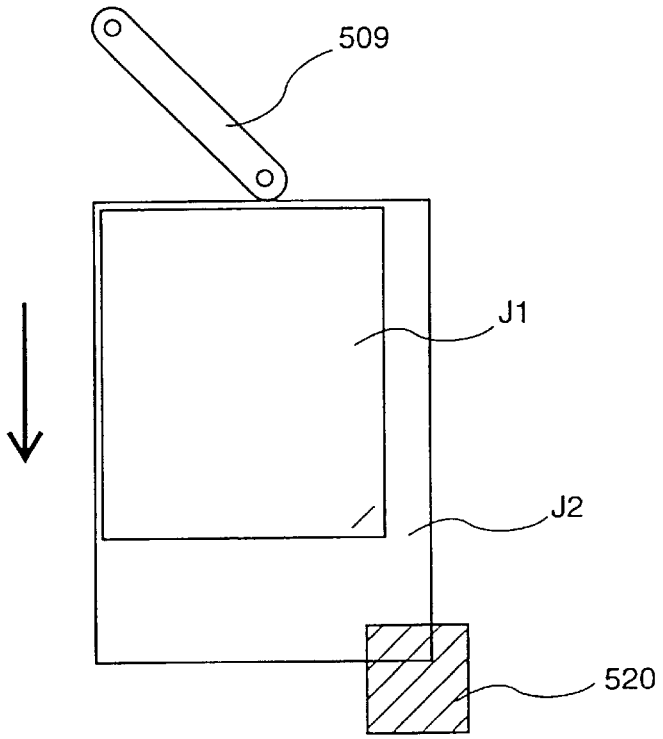
FIG. 32 shows a specific example of the process executed in the flow chart of FIG. 31.

Referring to FIG. 32, when a copy sheet J1 for the first job is larger than a copy sheet J2 for the second job, only the second job sheet J2 can be subjected to stapling process by stapler 520 when the copy sheet is pushed by pushing unit 509.

Figure 33:
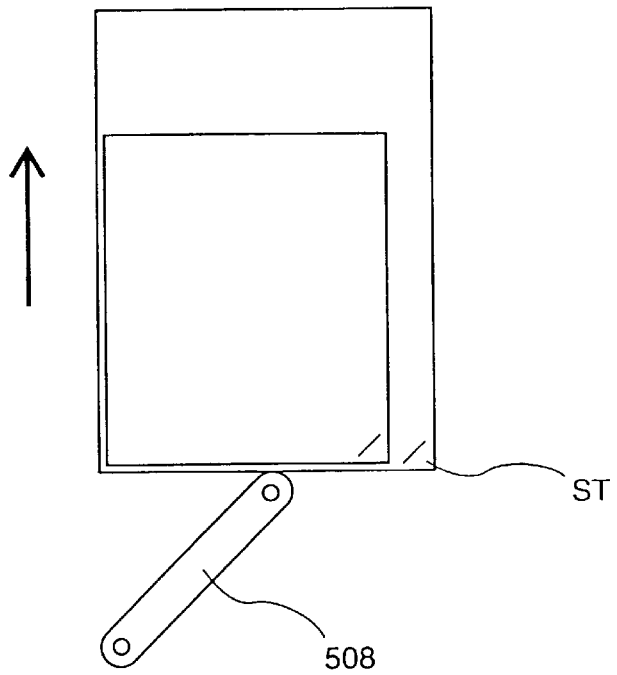
FIG. 33 is an illustration related to a process performed after the process of FIG. 32.

After the stapling process shown in FIG. 32, alignment unit 508 can align the sheets for the first and second jobs as shown in FIG. 33.

It is noted that in FIG. 33, the documents for the second job are stapled at the position ST.

According to this embodiment, alignment and stapling processes are carried out when the sheet for the second job is larger than the sheet for the first job. However, it may be possible to carry out alignment process when the size of the sheet for the second job is at least the size of the sheet for the first job. The reason is as follows. Although the sheets for the first and second jobs cannot be stapled individually on the same tray when the size of the sheets for the first job and that for the second job are equal, only the alignment process can be carried out on the same tray.

Advantages of the copying machine according to the embodiment are shown as (1)–(3).

(1) Even if the copy sheets for the first job are loaded on the discharge tray, post-processings such as alignment and stapling of the copy sheets for the second job are possible on the same tray when the width of the copy sheets for the second job is the same as or more than that for the first job.

(2) Successive processings of the first and second jobs are possible by dividing original documents into those for the first job and those for the second job and loading them respectively, when more than the number of sheets which can be loaded on the tray of ADF are to be copied.

(3) Any trouble due to inadequate input for the second job can be prevented since a possible range of inputting for the second job is displayed on the panel based on the setting for the first job.

The possible range of input can be provided by sound or the like.

In order to limit the setting of the copying operation mode in the second job according to the copying operation mode carried out in the first job, setting of the sorting operation in the second job may be made impossible when, for example, sorting operation is carried out using all of the bins of the sorter in the first job.

Although description given above is related to an analog copying machine, the present invention can be applied to a digital copying machine.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A processing apparatus used for an image forming apparatus capable of successively executing a plurality of jobs, comprising:

input means for inputting information related to a copying operation for a first job; and determination means for determining a copying operation which can be set for a second job carried out after said first job, based on information input by said input means and information of a copying operation which can be executed by said image forming apparatus.

2. The processing apparatus according to claim 1, further including display means for displaying the copying operation determined by said determination means.

3. The processing apparatus according to claim 1, wherein said copying operation which can be set for said second job includes the number of sheets to be copied.

4. The processing apparatus according to claim 1, wherein said copying operation which can be set for said second job includes the number of originals.

5. The processing apparatus according to claim 1, wherein said copying operation which can be set for said second job includes copying operations that can be set respectively in a sheet priority mode and a bin priority mode.

6. The processing apparatus according to claim 1 further including setting means for setting a grouping mode and a sorting mode, wherein said determination means makes determination based on the set mode.

7. The processing apparatus according to claim 1, further including setting means for setting a simplex copy mode or a duplex copy mode, wherein said determination means makes determination based on the set mode.

8. The processing apparatus according to claim 1, further including:

placement means for placing an original for said second job; and warning means for warning when information related to a copying operation for said second job is not input within a prescribed time after the original is placed on said on placement means.

* * * * *